US012662790B2

(12) United States Patent
Kaufman et al.

(10) Patent No.: US 12,662,790 B2
(45) Date of Patent: Jun. 23, 2026

(54) FOUNDATION SUPPORT SYSTEM SHAFTS, ASSEMBLIES AND METHODS WITH ASYMMETRIC TORQUE TRANSMITTING DISTAL END EDGE TEETH

(71) Applicant: PIER TECH SYSTEMS, LLC, Chesterfield, MO (US)

(72) Inventors: Kevin Kaufman, Des Peres, MO (US); Michael D. Wilkis, Ellisville, MO (US)

(73) Assignee: Pier Tech Systems, LLC, Chesterfield, MO (US)

( * ) Notice: Subject to any disclaimer, the term of this patent is extended or adjusted under 35 U.S.C. 154(b) by 246 days.

(21) Appl. No.: 18/477,951

(22) Filed: Sep. 29, 2023

(65) Prior Publication Data

US 2025/0109562 A1 Apr. 3, 2025

(51) Int. Cl.

| | |
|---|---|
| ***E02D 35/00*** | (2006.01) |
| ***E02D 5/28*** | (2006.01) |
| ***E02D 5/52*** | (2006.01) |
| ***E02D 5/56*** | (2006.01) |

(52) U.S. Cl.

CPC ..... *E02D 5/285* (2013.01); *E02D 5/523* (2013.01); *E02D 5/56* (2013.01); *E02D 35/00* (2013.01); *E02D 2600/20* (2013.01)

(58) Field of Classification Search

CPC ..... E02D 5/526; E02D 5/56; E02D 5/523; E02D 5/801; E02D 7/22; E02D 35/00; E02D 5/285

See application file for complete search history.

(56) References Cited

U.S. PATENT DOCUMENTS

| | | | | |
|---|---|---|---|---|
| 1,781,091 A | | 11/1930 | Wilson | |
| 4,512,596 A | | 4/1985 | Obrecht | |
| 4,623,025 A | * | 11/1986 | Verstraeten | E21B 7/26 405/253 |
| 4,821,818 A | | 4/1989 | Mefferd | |
| 6,615,554 B2 | | 9/2003 | Rupiper | |

(Continued)

FOREIGN PATENT DOCUMENTS

| | | | |
|---|---|---|---|
| CN | 110984148 | A | 4/2020 |
| EP | 2265848 | B1 | 8/2015 |
| EP | 9529075 | B1 | 10/2016 |
| JP | 2018066152 | A | 4/2018 |

(Continued)

OTHER PUBLICATIONS

PCT International Search Report and Written Opinion issued for Application No. PCT/US2024/048512, dated Nov. 15, 2024 (14 pages).

(Continued)

*Primary Examiner* — Frederick L Lagman

(74) *Attorney, Agent, or Firm* — Armstrong Teasdale LLP

(57) ABSTRACT

A foundation support system includes a hollow foundation support shaft formed with a first axial length and a first torque transmitting distal end edge including an asymmetric torque transmitting tooth. The asymmetric torque transmitting tooth includes a forward torque transmitting edge portion and a rearward force transmitting edge portion opposing the forward torque transmitting edge portion. The forward torque transmitting edge portion and the rearward torque transmitting edge portion have a respectively different shape and orientation on the first torque transmitting distal end edge.

37 Claims, 14 Drawing Sheets

(56) References Cited

U.S. PATENT DOCUMENTS

| | | | | |
|---|---|---|---|---|
| 7,037,045 | B2 * | 5/2006 | Jones | E02D 5/56 405/253 |
| 7,736,095 | B2 | 6/2010 | Fujita | |
| 7,748,932 | B2 | 7/2010 | Lindsey | |
| 8,602,689 | B1 | 12/2013 | Van Polen et al. | |
| 12,338,599 | B2 * | 6/2025 | Kaufman | E02D 35/005 |
| 2011/0217125 | A1 | 9/2011 | Kasprick et al. | |
| 2016/0215470 | A1 | 7/2016 | Reusing et al. | |
| 2016/0230364 | A1 | 8/2016 | Stroyer | |
| 2018/0030681 | A1 | 2/2018 | Stroyer | |
| 2019/0127940 | A1 | 5/2019 | Kaufman et al. | |
| 2019/0249387 | A1 | 8/2019 | Horie et al. | |
| 2021/0131055 | A1 | 5/2021 | Queen et al. | |
| 2023/0089034 | A1 | 3/2023 | Karantinidis | |
| 2024/0318398 | A1 | 9/2024 | Trebil et al. | |
| 2025/0207345 | A1 * | 6/2025 | Kaufman | E02D 5/56 |

FOREIGN PATENT DOCUMENTS

| | | | | |
|---|---|---|---|---|
| KR | 101118318 | B1 | 3/2012 | |
| KR | 10-2106-0025180 | A | 3/2016 | |
| KR | 20180112642 | A | 10/2018 | |
| KR | 101952704 | B1 * | 2/2019 | E02D 5/523 |
| KR | 20200102637 | A | 9/2020 | |
| KR | 102195847 | B1 | 12/2020 | |
| KR | 20220022005 | A | 2/2022 | |
| KR | 10-2022-0128266 | A | 9/2022 | |

OTHER PUBLICATIONS

Extended European Search Report issued for Application No. 23185902.6, on Dec. 8, 2023 (34 pages).

SafeBase "Helical Tiebacks," Product Specification Sheet. www.safebasementsinc.com.

* cited by examiner

STATE OF THE ART

FOUNDATION SUPPORT SYSTEM SHAFTS, ASSEMBLIES AND METHODS WITH ASYMMETRIC TORQUE TRANSMITTING DISTAL END EDGE TEETH

CROSS REFERENCE TO RELATED APPLICATIONS

This application relates in part to subject matter disclosed in U.S. application Ser. No. 18/351,589 filed Jul. 13, 2023 and now issued U.S. Pat. No. 12,338,599, which claims the benefit of U.S. Provisional Application Ser. No. 63/389,999 filed Jul. 18, 2022.

BACKGROUND OF THE INVENTION

The field of the invention relates generally to building foundation support systems including assemblies of structural support shaft components, and more specifically to mechanical, torque transmitting connections between foundation support shaft components such as helical piers.

If a building foundation moves or settles in the course of construction, or at any time after construction is completed, such movement or settlement may affect the integrity of the building structure and lead to costly repairs. While much care is taken to construct stable foundations in new building projects, certain soil types or other building site conditions, or certain types of buildings or structures, may present particular concerns that call for additional measures to ensure the stability of building foundations.

Helical piers, also known as anchors, piles or screwpiles, are deep foundation solutions commonly used when standard foundation solutions are problematic. Helical piers are driven into the ground with reduced installation time and little soil disturbance compared to large excavation work that may otherwise be required by standard foundation techniques, and a number of helical piers may be installed at designated locations to transfer and distribute the weight of the building structure to load bearing soil to prevent the foundation from moving or shifting. Lifting elements, support brackets or load-bearing caps may be used in combination with the helical piers to construct various types of foundation support systems meeting different needs for both foundation repair and new construction applications.

While known foundation support systems are satisfactory in many aspects, improvements are nonetheless desired.

DETAILED DESCRIPTION OF THE INVENTION

In order to understand the inventive concepts described herein to their fullest extent, some discussion of the state of the art and certain problems and disadvantages that exist in the art is set forth below, followed by exemplary embodiments of improved foundation support systems and components therefore which overcome such problems and disadvantages in the art.

Figure 1:
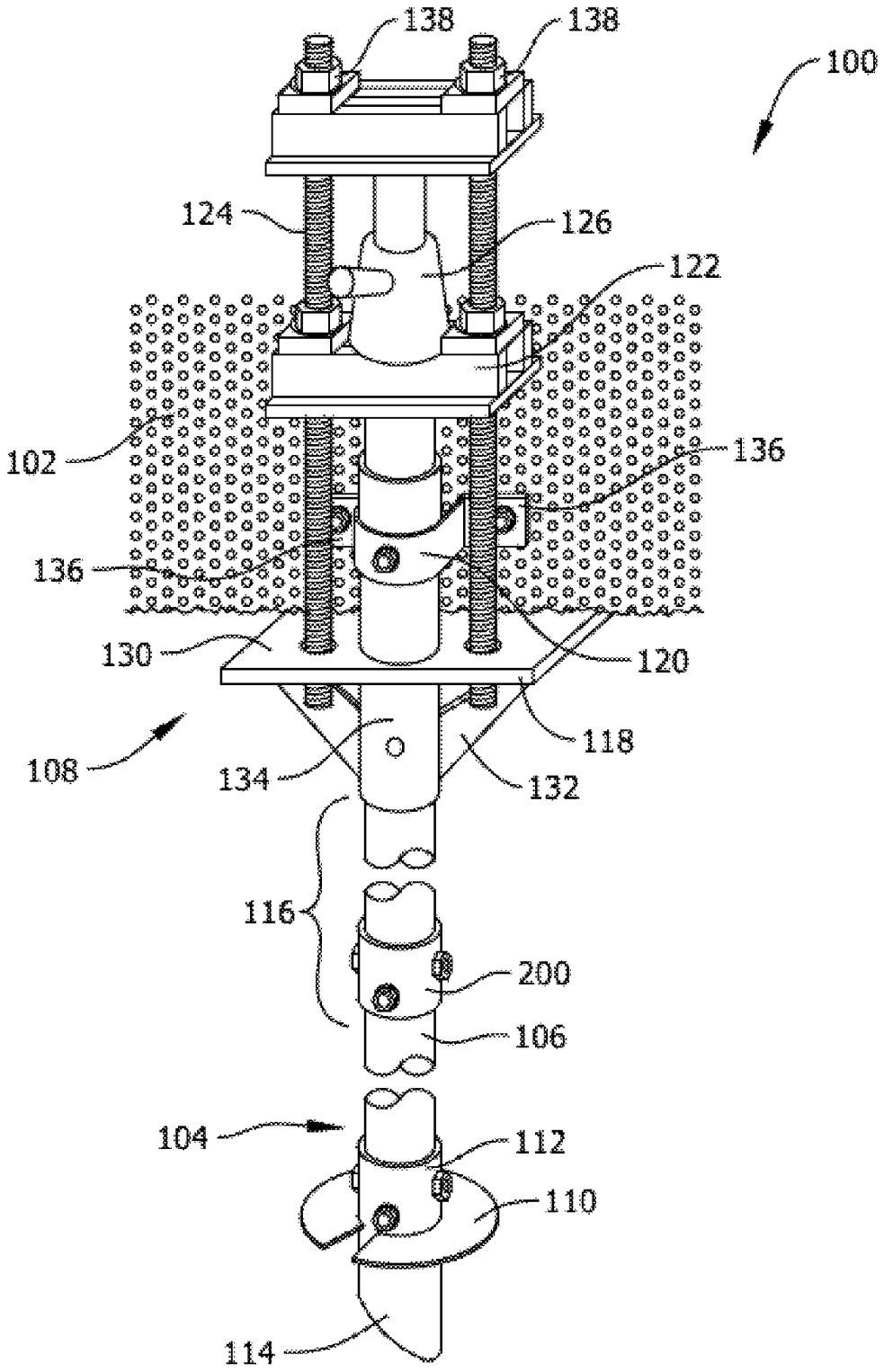
FIG. 1 is a perspective view of a conventional foundation support system interacting with a building structure.

FIG. 1 illustrates a perspective view of a conventional foundation support system 100 in combination with a building foundation 102 which in turn supports a structure in a residential, commercial or industrial construction site. The structure being supported by the building foundation 102 may include various types of buildings, homes, edifices, etc. in real estate developments and improvements. The foundation support system 100 may be applied in the new construction of the building foundation 102 prior to the structure being completed, or may alternatively be applied for maintenance and repair purposes in a retrofit manner to a pre-existing building foundation at any desired time after the foundation 102 and building structure are initially constructed. While exemplary structures are mentioned above, the foundation support system 100 may be used in a similar manner to provide foundation support for various different types of structures and to securely support anticipated structural loads without more extensive excavation that standard building foundations otherwise require to provide a similar degree of support. The foundation support system described and illustrated herein is therefore a non-limiting example of the type of system that may be benefit from the inventive concepts described further below.

Primary piles or pipe shafts (hereinafter collectively referred to as a "pile" or "piles") 104 of appropriate size and dimension may be selected and may be driven into the ground or earth at a location proximate or near the foundation 102 using known methods and techniques. The size of the primary pile 104 and the insertion depth needed to provide the desired support may be determined according to known engineering methodology and analysis of the construction site and the particular structure that is to be supported. The primary piles 104 typically consist of a long shaft 106 that is driven into the ground to the desired depth, and a support element such as a plate or bracket (not shown) or a lifting element such as a lifting assembly 108 may be assembled to the shaft 106 proximate the foundation 102. The shaft 106 of the primary pile 104 may also include one or more lateral projections such as a helical auger 110. Such helical steel piles 104 are available from, for example, Pier Tech Systems (www.piertech.com) of Chesterfield, Missouri.

The helical auger 110 may in some embodiments be separately provided from the piling 104 and attached to the piling 104 by welding to a sleeve 112 including the auger 110 provided as a modular element fitting. As such, the sleeve 112 of the modular fitting may be slidably inserted over an end of the shaft 106 of the piling shaft 104 and secured into place with fasteners such as bolts as shown in FIG. 1. In such an embodiment, the sleeve 112 includes one or more pairs of fastener holes or openings for attachment to the piling shaft 106 with the fasteners shown. In the embodiment illustrated there are two pairs of fastener holes formed in the sleeve 112, which are aligned with corresponding fastener holes in the shaft 106 to accept orthogonally-oriented fasteners and establish a cross-bolt connection between the shaft 106 and the sleeve 112. To make a primary pile 104 with a particular length one merely slides the sleeve 112 onto a piling shaft 106 of the desired length and affixes the sleeve 112 in place. In the illustrated embodiment, the end of the piling shaft 106 is provided with a beveled tip 114 to better penetrate the ground during installation of the pile 104. In different embodiments, the tapered tip 114 may be provided on the shaft 106 of the piling 104, or alternatively, the tip 114 may be a feature of the modular fitting including the sleeve 112 and the auger 110.

The lifting assembly 108 may be attached to an upper end of the primary pile 104 after being driven into the ground. If the primary pile 104 is not sufficiently long enough to be driven far enough into the ground to provide the necessary support to the foundation 102, one or more extension piles 116 can be added to the primary pile 104 to extend its length in the assembly. The lifting assembly 108 may then be attached to one of the extension piles 116.

As shown in FIG. 1, the lifting assembly 108 interacts with the foundation 102 to support and lift the building foundation 102. In a contemplated embodiment, the lifting assembly 108 may include a bracket body 118, one or more bracket clamps 120 and accompanying fasteners, a slider block 122, and one or more supporting bolts 124 (comprising all thread rods, for example) and accompanying hardware. In another suitable embodiment the lifting assembly 108 may also include a jack 126 and a jacking block 128. Suitable lifting assemblies may correspond to those available from Pier Tech Systems (www.piertech.com) of Chesterfield, Missouri, including for example only the TRU-LIFT® bracket of Pier Tech Systems, although other lifting assemblies, lift brackets, and lift components from other providers may likewise be utilized in other embodiments.

The bracket body 118 in the example shown includes a generally flat lift plate 130, one or more optional gussets 132, and a generally cylindrical housing 134. The lift plate 130 is inserted under and interacts with the foundation or other structure 102 that is to be lifted or supported. The lift plate 130 includes an opening, with which the cylindrical housing 134 is aligned to accommodate one of the primary pile 104 or an extension pile 116. The housing 134 is generally perpendicular to the surface of lift plate 130 and extends above and below the plane of lift plate 130.

In the example shown, one or more gussets 132 are attached to the bottom surface of the lift plate 130 as well as to the lower portion of the housing 134 to increase the holding strength of the lift plate 130. In one embodiment, the gussets 132 are attached to the housing 134 by welding, although other secure means of attachment are encompassed within this invention.

In the example shown, the bracket clamps 120 include a generally Q-shaped piece having a center hole at the apex of the "Q" to accommodate a fastener. The Q-shaped bracket clamp 120 includes ends 136, extending laterally, that include openings to accommodate fasteners. The fasteners extending through the openings in the ends 136 are attached to the foundation 102, while the fastener extending through the center opening at the apex of the "2" extends into an opening in the housing 134. In one embodiment the fastener extending through the center opening in the bracket clamp 120 and into the housing 134 further extends through one of the primary pile 104 or the extension pile 116 and into an opening on the opposite side of the housing 134, and then anchors into the foundation 102. In such cases, however, the fastener is not inserted through one of the primary pile 104 or the extension pile 116 until jacking or lifting has been completed, since bracket body 118 must be able to move relative to pile 104 or 116 in order to effect lifting of the foundation 102.

In one embodiment, the bracket body 118 is raised by tightening a pair of nuts 138 attached to the top ends of the supporting bolts 124. The nuts 138 may be tightened simultaneously, or alternatively, in succession in small increments with each step, so that the tension on the bolts 124 is kept roughly equal throughout the lifting process. In another suitable embodiment, the jack 126 is used to lift the bracket body 118. In this embodiment, longer support bolts 124 are provided and are configured to extend high enough above the slider block 122 to accommodate the jack 126 resting on the slider block 122, the jacking block 128, and the nuts 138.

When all of the components are in place as shown and sufficiently tightened, the jack 126 (of any type, although a hydraulic jack is preferred) is activated so as to lift the jacking plate 128. As the jacking plate 128 is lifted, force is transferred from the jacking plate 128 to the support bolts 124 and in turn to the lift plate 130 of the bracket body 118. When the foundation 102 has been lifted to the desired elevation, the nuts immediately above the slider block 122 (which are raised along with support bolts 124 during jacking) are tightened down, with approximately equal tension placed on each nut. At this point, the jack 126 can then be lowered while the bracket body 118 will be held at the correct elevation by the tightened nuts on the slider block 122. The jacking block 128 can then be removed and reused. The extra support bolt material above the nuts at the slider block 122 can be removed as well, using conventional cutting techniques.

The lifting assembly 108 and related methodology is not required in all implementations of the foundation support system 100. In certain installations, the foundation 102 is desirably supported and held in place but not moved or lifted, and in such installations the lifting assembly shown and described may be replaced by a support plate, support bracket or other element known in the art to hold the foundation 102 in place without lifting it first. Support plates, support brackets, support caps, and or other support components to hold a foundation in place are available from Pier Tech Systems (www.piertech.com) of Chesterfield, Missouri and other providers, any of which may be utilized in other embodiments of the foundation support system.

As mentioned, it is sometimes necessary to extend the length of a piling by connecting one or more shafts which in combination may provide support that extends deeper into the ground than the shafts individually can otherwise reach. For example, a first helical pier component, referred to as a primary pile, may be driven nearly fully into the ground at the desired location, and a connection component such as an extension pile may then be attached to the end of the primary pile in order to drive the primary pile deeper into the ground while supporting the building foundation at an end of the extension pile. More than one extension pile may be required depending on the lengths of the piles available and/or particular soil conditions.

However, attaching an extension pile to a primary pile to increase the length of the completed piling needed for the job can, be challenging. In conventional foundation support systems, including but not limited to the example shown in FIG. 1, the connection between the primary pile and extension pile is typically made via one or more bolts inserted through fastener holes in the ends of the primary pile and the extension pile. Conventionally, such fastener holes in some cases may be drilled on site as needed, or may be pre-formed in respective couplers that are attached to the primary pile and the extension pile. In either case, because the extension piece may be many feet long and is rather heavy, completing the desired connection to the primary pile with bolts presents a number of complications to an efficient and proper installation of the foundation support system.

As an initial matter, the primary pile and the extension pile must be properly aligned with one another so that the bolts can be inserted, and the bolts must then be tightened while the proper alignment is maintained. If the fastener holes to make the connections are not properly formed or are not properly aligned, difficulties in inserting the bolts are realized, especially so when the fastener holes are threaded and require precise and nearly exact alignment in order to install the bolts. Some trial and error positioning and repositioning of the extension pile is therefore typically required to align the primary pile and the extension pile so that the bolts can be installed, increasing the time and labor costs required to install a piling including the primary pile and the extension pile. When more than one extension pile is needed, such difficulties may be repetitively incurred with each extension pile and will cumulatively increase the time and labor costs required to install the foundation support system. Indeed, in some cases, installers may spend more time installing the bolts than driving the piles into the ground. Also, the difficulty incurred in aligning an extension pile to make the bolted connection to the primary pile can result in a bolted connection being completed, but in a suboptimal manner that can be compromise the integrity of the support system to provide the proper level of support and undesirably affect the support system capacity and reliability.

For example, the fastener holes may elongate or otherwise deform, or the bolts can be damaged, via any attempt to force-fit the bolts when difficulties are encountered or when subsequent torque is applied to drive the piling further into the ground. Any such damage or deformation of fastener holes can reduce the structural strength or capacity of the foundation support system. Likewise, the bolts may not be properly loaded if they are not installed as intended (e.g., if the bolts are installed at unintended angles), which can cause overstress and deformation of the fastener holes when subjected to torsional forces to drive the extension pile and primary pile into the ground. Apart from issues relating to the installation of the bolts themselves with a proper alignment relative to the fastener holes, the mechanical torque transmission between the ends of shafts is transmitted through the bolts as the installation of the system is completed by driving the shafts into the ground to the desired depth. The torsional load carried by the bolts, in turn, may result in sufficiently high mechanical stress so as to deform the fastener holes in the shafts.

Any deformation of the fastener holes, or misalignment of the bolts, may further cause a possibility of the joined ends of the primary pile and the extension pile to move relative to one another. Such relative movement is sometimes referred to herein as "play", and is inherently undesirable and detrimental to the intended support for the foundation that the pilling is supposed to present. Any play in the components during assembly may also introduce additional alignment difficulties and complications in completing a proper installation of the foundation system altogether, and may undesirably increase time and labor costs to complete the installation of the foundation support system.

More recent foundation support systems and components therefor have been developed to reduce the difficulties of interconnecting the foundation support components in the installation of a foundation support system, including but not necessarily limited to a primary pile and an extension pile. For example, patented, self-aligning coupler assemblies are available from Pier Tech Systems (www.piertech.com) of Chesterfield, Missouri that have greatly reduced the difficulties in establishing bolted connections in an installation of a foundation support system. See, e.g., U.S. Pat. Nos. 9,506,214; 9,863,114; 10,294,623; and 10,844,569. The patented Pier Tech couplers include elongated axially extending ribs and elongated axially extending grooves that are mated to one another to establish torque transmitting connections therebetween, with self-alignment of the fastener holes as the couplers are mated to more easily complete the desired bolted connections. The bolts are also mechanically isolated from torque transmission forces in the patented Pier Tech couplers, both for ease of installation and to prevent a problematic deformation of the fastener holes that otherwise may tend to occur. Simpler, easier and more reliable installation of foundation support systems is therefore possible with the patented Pier Tech couplers, but further improvement remains desirable.

Figure 2:
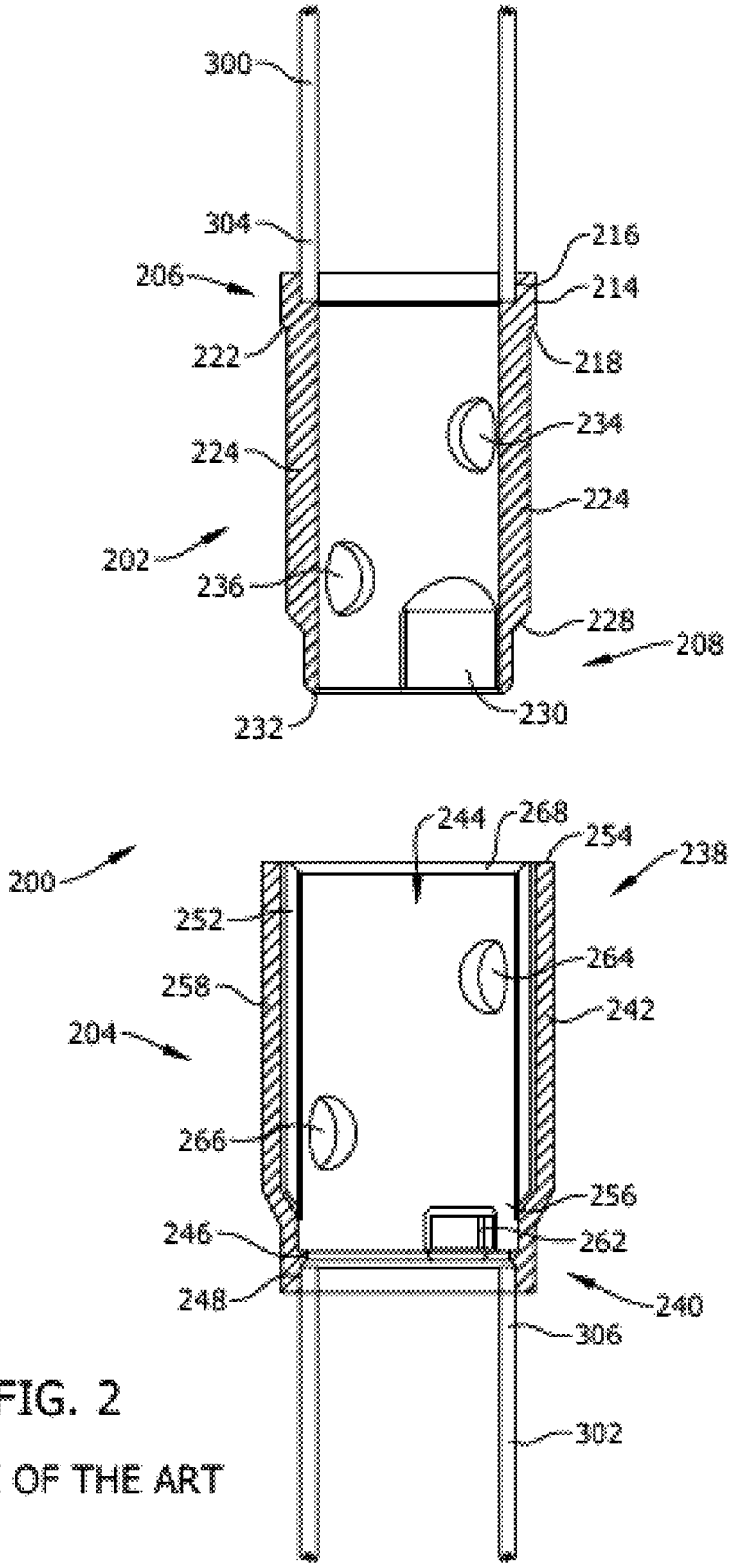
FIG. 2 shows a cross-sectional view of a conventional shaft coupling arrangement for the foundation support system shown in FIG. 1 including an inner coupler and an outer coupler having a non-uniform wall thickness.

FIG. 2 shows a conventional coupler assembly 200 that is described in the aforementioned patents for the patented Pier Tech couplers. FIG. 2 shows the coupler assembly 200 in cross-sectional view wherein the coupler assembly 200 is seen to include an inner coupler 202 attached to a shaft of a first piling 300 and an outer coupler 204 attached to a shaft of a second piling 302. In one embodiment, pilings 300 and 302 each include a length of pipe fabricated from a metal such as steel. The couplers 202, 204 may likewise be integrally formed from a metal material such as steel according to known techniques to include the features shown. The first piling 300 may be of the same dimension in terms of its inner and outer diameter and correspond in cross sectional shape to the second piling 302, to which it is attached. Alternatively stated, the pilings 300, 302 being connected via the coupler assembly 200 are constructed to be the same, albeit with possibly different lengths, although this not necessarily required in all embodiments. The cross-sectional shape of the pilings 300, 302 can be circular, square, hexagonal, or another shape as desired. The pilings 300, 302 can be made to different lengths, however, as the application requires, and the pilings 300, 302 can be hollow or filled with a substance such as concrete, chemical grout, or another known suitable cementitious material or substance familiar to those in the art to enhance the structural strength and capacity of the pilings in use. The pilings 300, 302 may be prefilled with cementitious material in certain contemplated embodiments.

Likewise, in other contemplated embodiments, cementitious material, including but not necessarily limited to grout material familiar to those in the art, may be mixed into the soil around the pilings 300, 302 as they are being driven into the ground, creating a column of cementitious material around the pilings for further structural strength and capacity to support a building foundation. Grout and cementitious material may be pumped through the hollow pilings under pressure as the pilings are advanced into the ground, causing the hollow pilings to fill with grout, some of which is released exterior to the pilings to mix with the soil at the installation site. Openings and the like can be formed in the pilings to direct a flow of cementitious material through the pilings and at selected locations into the surrounding soil.

In the embodiment shown in FIG. 2, the first piling 300 may correspond to an extension piling, such as the extension piling 116 shown in FIG. 1, and the second piling 302 may correspond to a primary piling, such as the primary piling 104 shown in FIG. 1. As noted above, the coupler assembly 200, however, may alternatively be used to connect other shafts of other foundation elements in the foundation support system 100 previously described, or still further may be utilized to connect other structural shaft elements in another application apart from foundation support. In the exemplary embodiment shown, the shaft of the first piling 300 includes a distal end 304, to which is coupled the inner coupler 202, and the shaft of the second piling 302 includes a distal end 306, to which is coupled the outer coupler 204. The distal ends 304 and 306 are positioned adjacent each other such that the inner coupler 202 is configured to be at least partially inserted into the outer coupler 204. As the inner coupler is inserted into the outer coupler, or as the outer coupler is received over the inner coupler, effective torque transmission between the couplers is realized via mating ribs and grooves that respectively project from or are indented in the respective inner and outer side surfaces of the couplers.

As seen in FIG. 2, the patented Pier Tech couplers 202, 204 employ a larger diameter coupler section at the end of each shaft 300, 302 being joined in the installation of the foundation support system. That is, the diameter of the coupler section 202, 204 for each respective shaft 300, 302 is increased relative to the remainder of the shaft so that an increased wall thickness is available in the coupler sections 202, 204 to define the respective outwardly projecting ribs 224 and inwardly extending grooves 252. The increased wall thickness, in turn, provides increased structural strength to transmit torque (via the mated ribs 224 and grooves 252) between the shafts 300, 302 as they are driven into the ground to support a building foundation. From the mechanical perspective, such larger diameter couplers 202, 204 with non-uniform wall thickness functions well, but from the manufacturing perspective it requires some rather complex, intricate shaping of the inner and outer couplers 202, 204 in the fabrication thereof. The additional material (e.g., additional steel) needed to manufacture the coupler sections 202, 204 and fabricating the coupler sections with such a complex shape increases the cost of manufacture of foundation support systems.

In use, the inner and outer couplers 202, 204 in the example of FIG. 2 operate to prevent a direct end-to-end engagement of the distal end edges of the shafts 300, 302 and instead establish an indirect connection of the shaft distal ends through the mating features of increased wall thickness in the couplers 202, 204. In the arrangement of FIG. 2, the couplers 202, 204 extend between and separate the flat distal end edges of the shafts 300, 302 which extend in a plane normal or perpendicular to the longitudinal center axis of the shafts 300, 302. By virtue of the separation between the distal end edges of the shafts 300, 302 there is no direct abutment or direct engagement between the distal end edges of the shafts. Instead, the couplers 202, 204 directly engage one another in a radial direction along the sidewall surface at locations spaced from the distal end edges of the shafts.

Additionally, and as shown in FIG. 2, two coupler sections 202, 204 of different shapes are required to make the desired torque transmitting connections between the shafts 300 and 302, namely the inner coupler 202 and the outer coupler 204 that are mated to one another with the ribs 252 and grooves 254 described in the aforementioned patents. Each of the inner coupler 202 and the outer coupler 204 require a different and relatively complex shape in fabrication that increases cost of fabrication of the couplers from high-strength materials (e.g., steel).

Still further, manufacturing steps of welding separately fabricated couplers 202, 204 to the shafts 300, 302 may be required at further expense in the manufacturing process. Separately fabricated couplers 202, 204 may avoid complications of shaping integrally formed coupler features (e.g., ribs and grooves formed on enlarged diameters at the ends of each shaft), but such cost savings are at least partially offset by the cost of welding the couplers 202, 204 to the shafts 300, 302. Furthermore, welding processes can be subject to imperfections that may cause the welds to weaken, sometimes to the point of failure, either during installation of the foundation support system or afterward. Weakened and failed connections are of course, undesirable, and would require additional time and expense to replace or repair components to install the piling at the proper depth and/or to ensure the desired structural strength of the connections made in the foundation support system.

In other embodiments, the shafts 302, 304 may be integrally formed and built-in design features with enlarged diameters and non-uniform wall thickness at the respective ends thereof to define the rib and groove coupling features as described in the aforementioned patents. For example, the coupler features (e.g., the ribs and grooves on the enlarged diameters) may be forged or swaged on the end of the shafts. Such integral coupler features may avoid the cost and reliability issues of welding processes to attach separately provided couplers as described above, but raise the manufacturing costs of the shafts 302, 304.

Regardless of whether the coupler features are welded, forged or swaged on the ends of the shafts 300, 302 an inventory of different shafts 300, 302 having different coupling features (e.g., inner/outer or male/female connection) is required for the installation of foundation support systems including primary piles and extension piles. To make the torque transmitting connection with the couplers 202, 204 one of the piles is provided with the coupler 202 while the other of the piles is provided with the coupler 204. Manufacturing, stocking and distributing such different primary piles and extension piles respectively including one of the couplers 202 or 204, including primary and extension piles in a number of various different axial length for modular assembly of a foundation support system, further adds cost and complexity from the supply chain perspective. Such costs are further multiplied considering that the diameter of the shafts 300, 302 may vary in the installation of different foundation support systems presenting different loads on the shafts, and therefore shafts with non-uniform wall thickness defining male and female coupling features in various different diameters are needed to fully meet the needs of different installation sites.

The aforementioned Pier Tech Systems patents teach additional embodiments of coupler sections besides than those shown in FIG. 2 employing that likewise employ torque transmitting ribs and grooves for beneficial use in foundation support installations, but the additional embodiments likewise implicate similar issues (e.g., non-uniform wall thickness and complex shaping of the coupler sections) and concerns from the manufacturing and distribution perspective (e.g., relatively high fabrication cost and relatively high component part counts in the supply chain). Simpler and lower cost fabrication with simpler supply chains are accordingly desired to more completely meet the needs of the foundation support system marketplace.

In view of the issues above, simpler and lower cost manufactures of coupled shaft assemblies are accordingly desired to more effectively meet longstanding but unfilled needs in the marketplace, without sacrificing ease of assembly and installation of foundation support assemblies and without compromising foundation support system integrity and reliability.

The co-pending and commonly owned U.S. application Ser. No. 18/351,589 referenced in paragraph above discloses foundation support shafts with profiled distal end edges that may be directly abutted and engaged as a partial solution to the problems above. The profiled distal ends disclosed U.S. application Ser. No. 18/351,589 incorporate distal end edge profiles having alternating symmetric cavities and symmetric extensions to realize direct engagement for torque transmission between distal end edges of the shafts when the cavities and extensions are mated with one another. The cavities and extensions include wavy parabolic shapes, rectangular shapes and triangular shapes. Such symmetric extensions and cavities may in some applications desirably transmit forward and reverse torque between identically shaped engagement surfaces. In certain applications, however, a differentiation between forward and reverse torque transmission would be desirable, so improvements are desired.

Inventive embodiments of coupled shaft assemblies are disclosed herein that may be beneficially used in foundation support systems of the type described above or in other types of coupled shaft assemblies presenting similar concerns to those described above and/or which would benefit from the advantages realized by the present invention. Accordingly, while the present invention is described in the context of foundation support system assemblies, such description is for the sake of illustration rather than limitation. Method aspects of fabricating and assembling the coupled shafts will be in part apparent and in part explicit in the following description.

Inventive coupled shaft assemblies in exemplary embodiments of the invention include first and second shafts each having the same diameter and each provided with complementary torque transmitting distal end edges that directly abut one another, and a coupler sleeve that receives and surrounds each of the profiled distal end edges of the first and second shafts. The first and second shafts may be identically constructed insofar as the mating features defined in the torque transmitting distal end distal end edges, and the first and second shafts may be fabricated in the same or different axial length for modular assembly in the installation of a foundation support assembly. Advantageously, different shafts having differently configured coupler features and/or increased wall thickness in coupler features are not required in the coupled shaft assembly of the invention, and fabrication costs are therefore reduced. Inventory and distribution issues to provide a range of foundation support systems are likewise simplified and associated costs are further reduced.

The torque transmitting distal end edges advantageously include asymmetrically-shaped torque transmitting teeth having differently shaped and differently oriented forward and reverse torque end edge engagement surfaces. Specifically, a curved end edge engagement surface and a linear end edge engagement surface may be provided on opposing sides of the asymmetrically-shaped torque transmitting teeth to provide respectively different force distributions when subjected to forward or reverse torque in the installation of the foundation support system. The number of asymmetric torque transmitting teeth on the torque transmitting distal end edges may be varied depending on expected torque loads in foundation support system installation. The asymmetric torque transmitting teeth may also be simpler to fabricate than certain types of symmetrical extensions and cavities in the aforementioned U.S. application Ser. No. 18/351,589 due to reduction in the number of curved or flat surfaces required to complete the desired end-to-end engagement at the torque transmitting distal end edges.

The coupler sleeve is advantageously a constant diameter shaft section having uniform wall thickness between opposing ends thereof. The coupler sleeve may have a larger outer diameter or a smaller inner diameter than the respective outer diameter or inner diameter of the shafts being directly engage via the asymmetric torque transmitting teeth on each shaft. The coupler sleeve may snugly receive the torque transmitting distal end edges of each shaft, and the coupler may be bolted to each shaft at a distance from the asymmetric torque transmitting teeth provided in each shaft. The shafts with profiled end edges and the coupler sleeve of the invention are more simply shaped and use relatively less material than more complicated coupler arrangements designed for torque transmission such as that shown in FIG. 2. Accordingly, the shafts and couplers of the invention may be manufactured and provided at relatively low cost while still providing effective torque transmission and ease of assembly, including self-aligning fastener holes to install the bolts. By attaching the coupler sleeve with the first bolt to a first one of the shafts to surround the profiled distal end edge of the first shaft, the second shaft can be inserted into the opposite end of the sleeve coupler in a generally self-guided manner as the asymmetric torque transmitting teeth of the second shaft abut the asymmetric torque transmitting teeth of the first shaft within the coupler sleeve. When the asymmetric torque transmitting teeth of the first and shafts are fully mated, the bolt holes in the second shaft and in the second coupler will be self-aligned for simple installation of the second bolt to complete the assembly.

Figure 3:
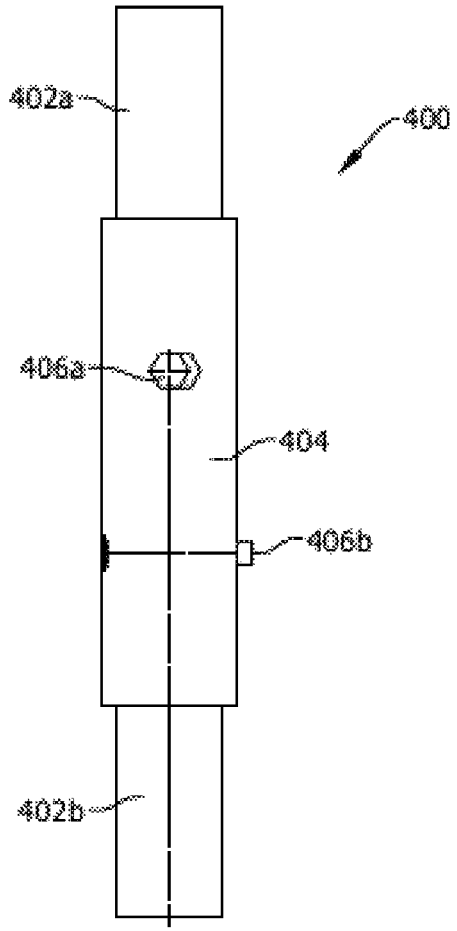
FIG. 3 is a side elevational view of a first exemplary coupled shaft assembly configured in accordance with a first exemplary embodiment of the present invention for rotatable torque transmission between shafts in an installation of a foundation support system such as that shown in FIG. 1.
Figure 4:
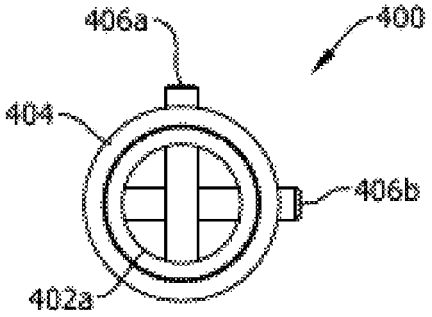
FIG. 4 is a top end view of the coupled shaft assembly shown in FIG. 3.
Figure 5:
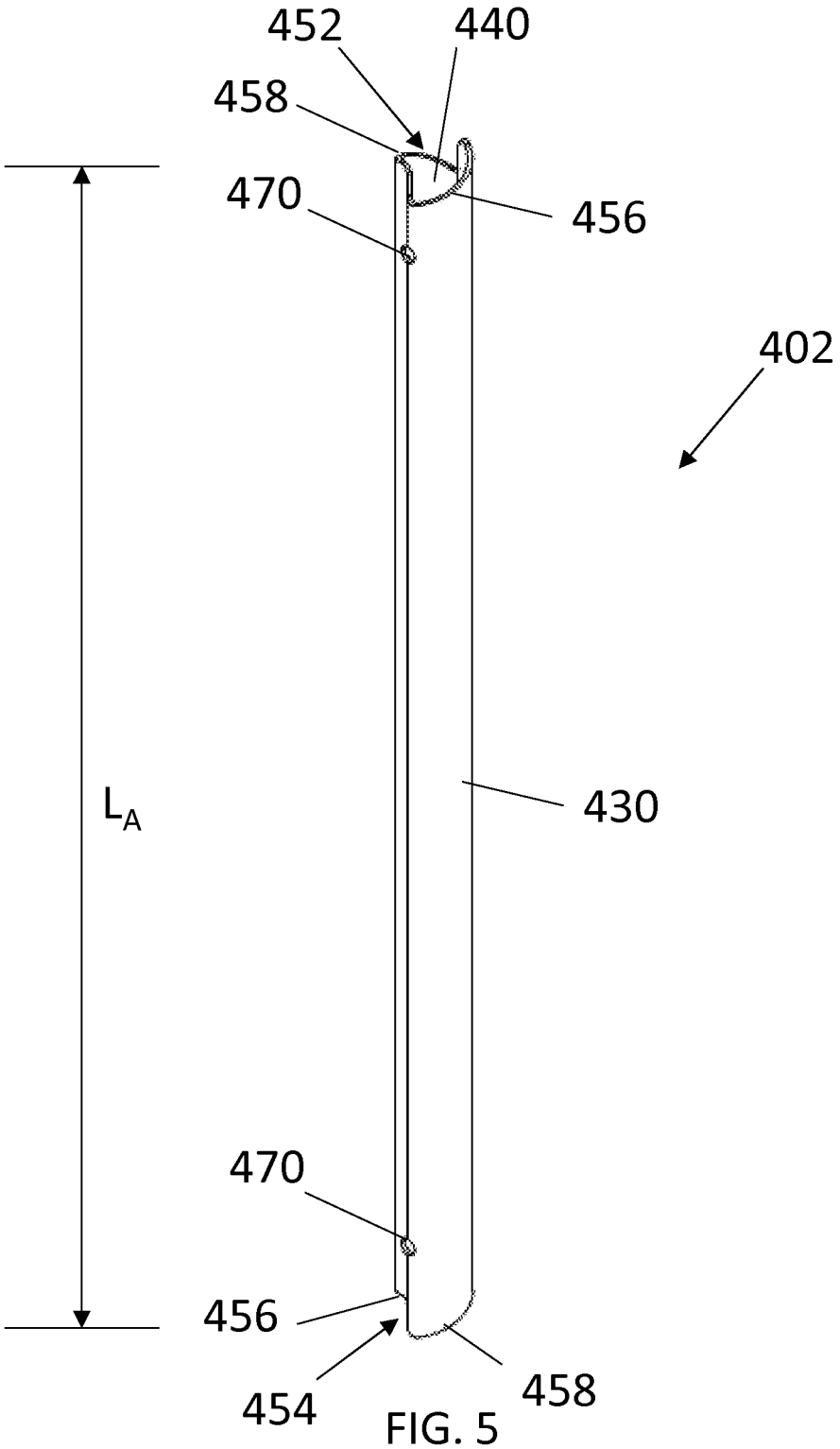
FIG. 5 is a perspective view of a first exemplary foundation support shaft for the coupled shaft assembly shown in FIGS. 3 and 4.

Referring now to the Figures, FIGS. 3-5 show an exemplary embodiment of a coupled shaft assembly 400 that may be used in lieu of the coupler assembly 200 in a foundation support system 100 such as that shown in FIG. 1. The coupled shaft assembly 400 includes a first shaft 402*a*, a second shaft 402*b*, and a coupler sleeve 404 that is fastened to the shafts 402*a*, 402*b* with fasteners such as bolts 406*a*, 406*b*.

The shafts 402*a*, 402*b* are fabricated from a high strength material such as steel according to known techniques and methods, although in alternative embodiments materials other than steel may be effectively utilized. Such alternative materials may include metal materials other than steel, non-metal materials, or composite materials having, for example, metal and non-metal constituents in combination to provide shafts of sufficient structural strength for an application such as a foundation support system. Provided that the shafts 402*a*, 402*b* have the required structural strength and ability to withstand ambient conditions in use for an adequate lifetime of the end use application of the coupled shaft assembly, a number of different materials may be utilized to fabricate the shafts 402*a*, 402*b* in a wide variety of manufacturing processes that are known and within the purview of those in the art without further explanation.

In the example shown the shafts 402*a*, 402*b* are fabricated as elongated cylindrical or tubular elements having a circular cross section and having the same inner diameter and outer diameter as seen in the end view of FIG. 4. While shafts 402*a*, 402*b* are shown in the illustrated examples with a circular cross-sectional shape, the shafts 402*a*, 402*b* may instead have a non-circular cross-sectional shape, including but not limited to a square cross-sectional shape, a hexagonal cross-sectional shape, or any other cross-sectional shape desired that is capable of meeting the needs of the end use application.

In a contemplated embodiment, the shaft 402*b* may be, for example, a primary pile for a foundation support system, while the shaft 402*a* may be an extension pule for a foundation support system. The primary pile 402*b* may include a helical auger element 110 (FIG. 1) and the primary pile 402*b* and extension pile 402*a* may be fabricated with any axial length desired to realize a combined shaft length to install the pile at the desired depth in the ground. The primary pile 402*b* and the support pile 402*a* may have the same or different axial length relative to one another.

In another embodiment, each of the shafts 402*a*, 402*b* may be extension piles of a foundation support system. The extension piles may likewise have the same or different axial length relative to one another.

In still another embodiment, the shaft 402*a* may be associated with a foundation support element such as a cap, a plate, or a lift bracket to support a building foundation in combination with the shaft 402*b* which may be either a primary pile or a secondary pile. Likewise, the shaft 402*a* may be associated with a drive tool that applies torque to the shaft 402*b* for driving it into the ground with the connected shaft 402*b* in a foundation support system installation.

The coupler sleeve 404 is fabricated from a high strength material such as steel and in the example shown is fabricated as an elongated cylindrical or tubular element having a circular cross section with an inner diameter slightly larger and about equal to the outer diameter of the shafts 402*a*, 402*b* and an outer diameter that is greater than its inner diameter as seen in the end view of FIG. 4. Like the shafts 402*a*, 402*b*, the sleeve 404 is formed with a uniform wall thickness along an entirety of the axial length (i.e., the vertical end-to-end length of the sleeve 404 in the plane of the page for FIG. 3). In another embodiment, the sleeve 404 may have a non-circular cross section, including but not limited to a square cross section or a hexagonal cross section. While the sleeve 404 has a complementary cross-sectional shape (i.e., circular cross-sectional shape in the illustrated examples) to the shafts 402*a*, 402*b*, in another embodiment the sleeve 404 and shafts 402*a*, 402*b* may have non-complementary cross-sectional shapes. For example, the sleeve 404 may have a square or hexagonal outer surface while still snugly receiving the distal ends of the circular shafts 402*a*, 402*b* on the interior of the coupler. Numerous variations are possible in this regard.

The bolts 406*a*, 406*b* respectively extend through the coupler sleeve 404 and through each of the shafts 402*a*, 402*b* as seen in the end view of FIG. 4. In the illustrated example shown in FIGS. 3 and 4, the first and second bolts 406*a*, 406*b* extend through the coupler sleeve 404 and through a respective one of the respective shafts 402*a* or 402*b*. The first and second bolts 406*a*, 406*b* are oriented such that the axial lengths of the bolts 406*a*, 406*b* are angularly offset from one another, and in the example shown the bolts 406*a*, 406*b* extend in perpendicular orientations to one another that is sometimes referred to as a cross-bolt configuration. It is recognized, however, that the cross-bolt configuration shown and described could be considered optional in some embodiments, and that the bolts 406*a*, 406*b* accordingly could be angularly offset at angles other than 90°.

In contemplated embodiments, the bolts 406*a*, 406*b* are mechanically isolated from forward torque transmission that is established entirely through torque transmitting engagement surfaces formed in the torque transmitting distal end edges of the mated shafts 402*a*, 402*b* as further described below. In other embodiments, however, the forward torque transmission may be shared between the mated shafts 402*a*, 402*b* and the bolts 406*a*, 406*b*, and in such a case the perpendicular orientation of the bolts 406*a*, 406*b* advantageously distributes shear stress in the coupler sleeve 404 in an improved manner relative to "in-line" bolts that are conventional to some types of foundation support systems.

Figure 13:
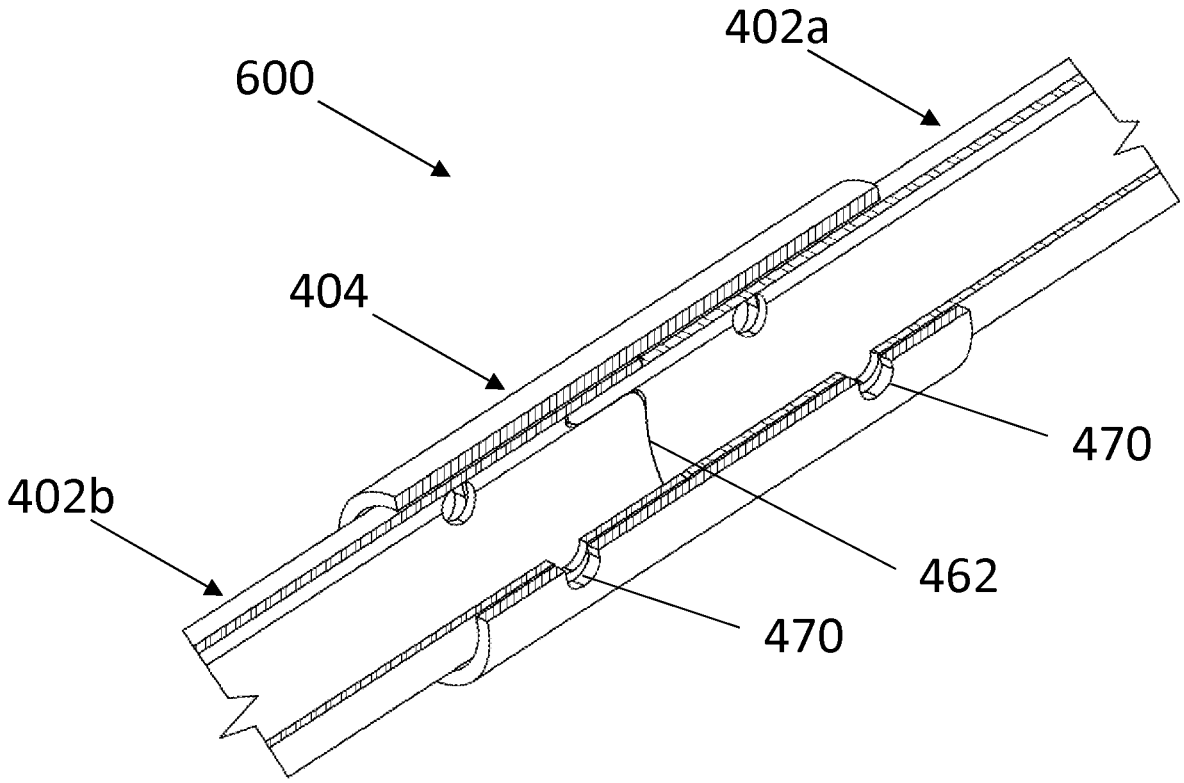
FIG. 13 is a sectional view of a second exemplary coupled shaft assembly including shafts as shown in FIGS. 5-13.
Figure 14:
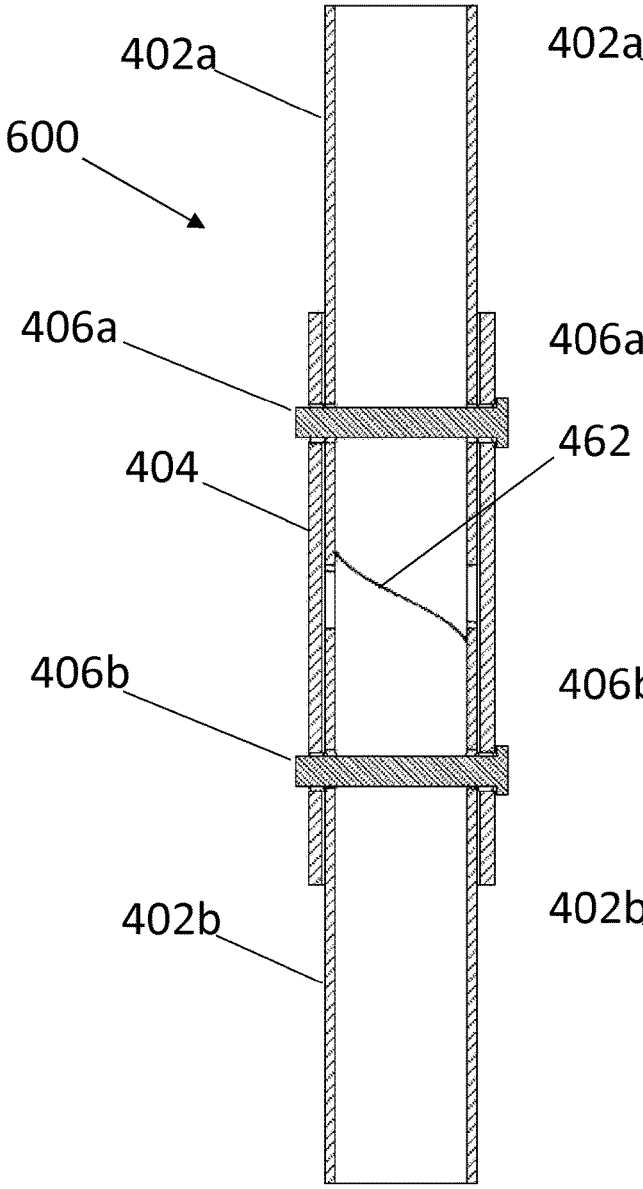
FIG. 14 is another sectional view of the coupled shaft assembly shown in FIG. 13.
Figure 15:
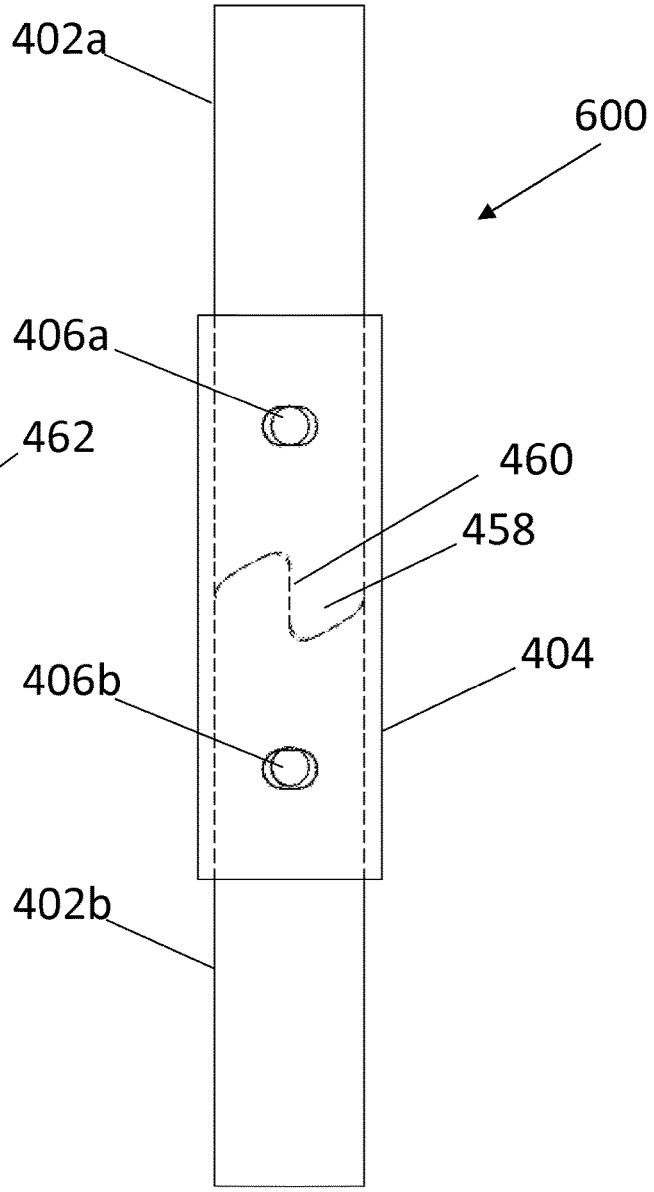
FIG. 15 is a partial transparent view of the coupled shaft assembly shown in FIGS. 13 and 14.

For purposes of the present description, "in-line bolts" are extended with their axial length aligned and parallel to one another and are therefore not angularly offset. In-line bolts orientations are specifically contrasted with the angularly offset (i.e., non-parallel) cross-bolt orientation of the bolts 406*a*, 406*b* that extend perpendicular to one another as described. It is recognized, however, that in some embodiments in-line bolt orientations may be acceptable and therefore may be utilized in the coupled shaft assembly 400. Accordingly, FIGS. 13-15 illustrate a coupled shaft assembly 600 including an in-line bolt orientation to secure an engagement of otherwise similar direct torque transmitting end edge engagement surfaces in the shafts being connected.

The foregoing examples of coupled shaft assemblies in FIGS. 3-4 and 13-15 include an external coupler sleeve 404 extending around an outer circumference of distal ends of the shafts 402*a*, 402*b*. Alternative embodiments may include, however, an internal coupler sleeve extending interior to the distal ends of the shafts and being fastened to the shafts in a similar manner, while still realizing the benefits of establishing the direct, end-to-end torque transmission via the profiled distal end edges of the shafts described.

FIGS. 5-10 are respective views of an exemplary foundation shaft 402 that may be used as one or both of the shafts 402*a* or 402*b* in the coupled shaft assembly shown in FIG. 3-4 or 13-15.

Figure 7:
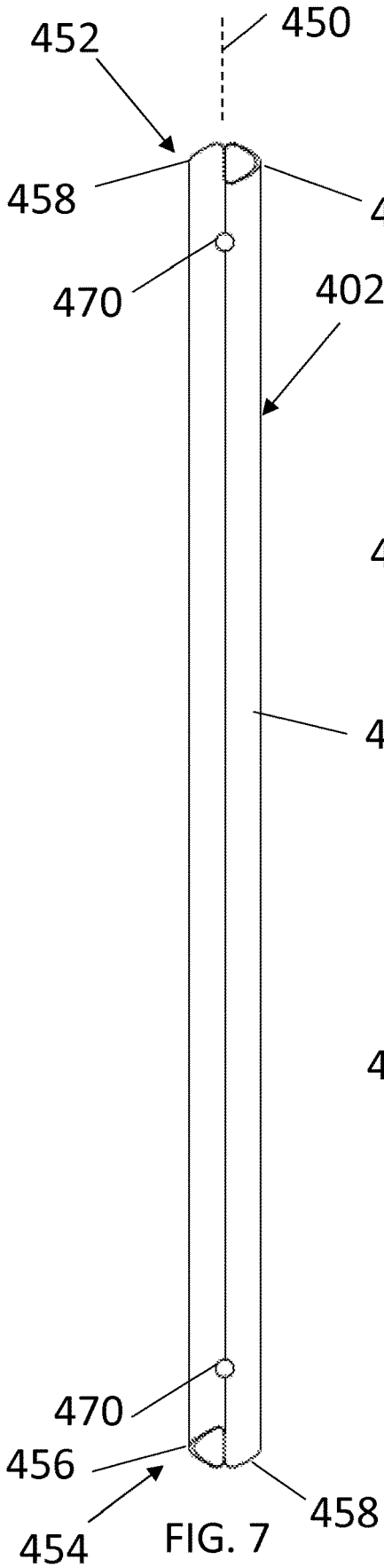
FIG. 7 is a front elevational view of the foundation support shaft shown in FIG. 5.
Figure 9:
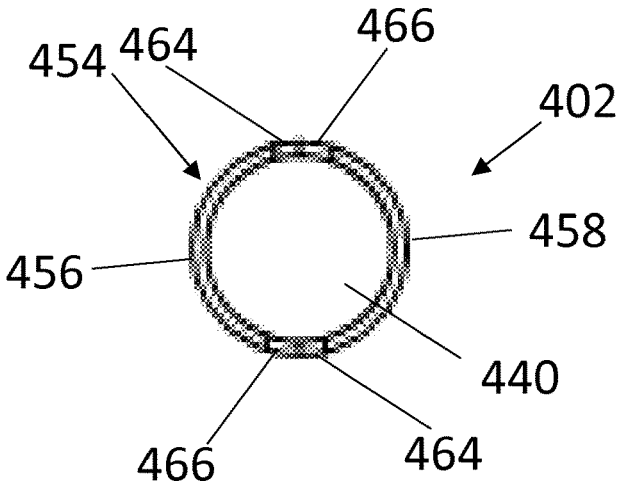
FIG. 9 is an enlarged bottom end view of the foundation support shaft shown in FIG. 7.
Figure 10:
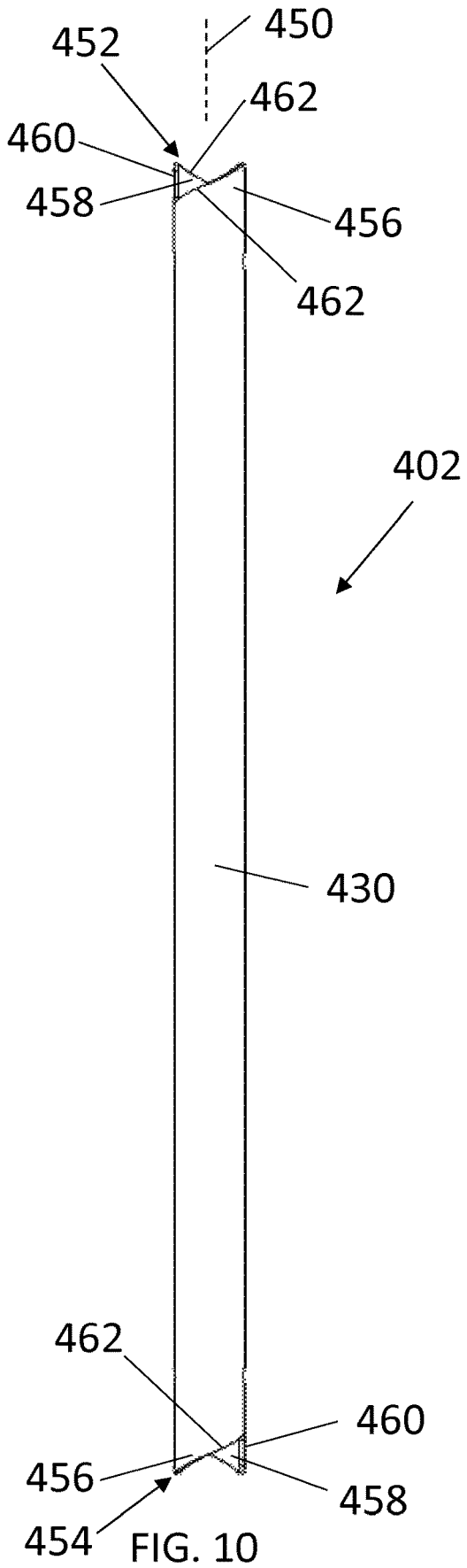
FIG. 10 is a side elevational view of the foundation support shaft shown in FIGS. 5 and 7.

As shown in perspective view in FIG. 5, the shaft 402 is an elongated foundation support shaft including an elongated shaft body 430 formed with an axial length LA measured end-to-end along a longitudinal center axis 450 shown in the front view of FIG. 7 and in the side view shown in FIG. 10. As shown in top view of FIG. 8 and bottom view in FIG. 9, the shaft body 430 has a uniform cross section along its entire axial length LA and in the example shown, the shaft 402 at both ends of the elongated body 430 has a uniform circular outer diameter and a circular inner diameter enclosing a hollow central space or area 440 on an interior of the shaft 402. The wall thickness (i.e., the difference between the inner diameter and the outer diameter) is constant at both ends of the shaft body 430 as well as in between the ends of the body 430 of the shaft 402. As such, changes in the wall thickness of the shaft body 430 are avoided, and so are manufacturing complications such as increased amounts of material and more complicated shaping of the material that are associated with areas of increased wall thickness. Dimensionally, the outer diameter and inner diameter of the shaft body 430 are a very small fraction of the axial length LA.

Referring now to FIGS. 5-7 and 10, the body 430 of the shaft 402 includes opposing torque transmitting distal end edges 452 and 454. The torque transmitting distal end edges 452 and 454 as explained further below are substantially identical to one another in the example shown but reversed relative to one another such that the features of the torque transmitting distal end edge 452 are rotated about 180° relative to the corresponding features of the torque transmitting distal end edges 454 and vice-versa. Such reverse position of the torque transmitting distal end edges 452, 454 allows the shaft 402 to be driven on the top end via applied torque on the top edge 452 from another shaft 402 or a drive tool in the installation of the foundation support system, while also driving another shaft at the bottom edge 454. In the coupled shaft assembly 400 (FIGS. 3 and 4) the top distal end edge 452 of one shaft 402 (e.g., the shaft 402*b* in FIG. 3) is directly engaged to the complementary bottom distal end edge 452 of another shaft 402 (e.g., the shaft 402*a* in FIG. 3) within the coupler sleeve 404.

Figure 6:
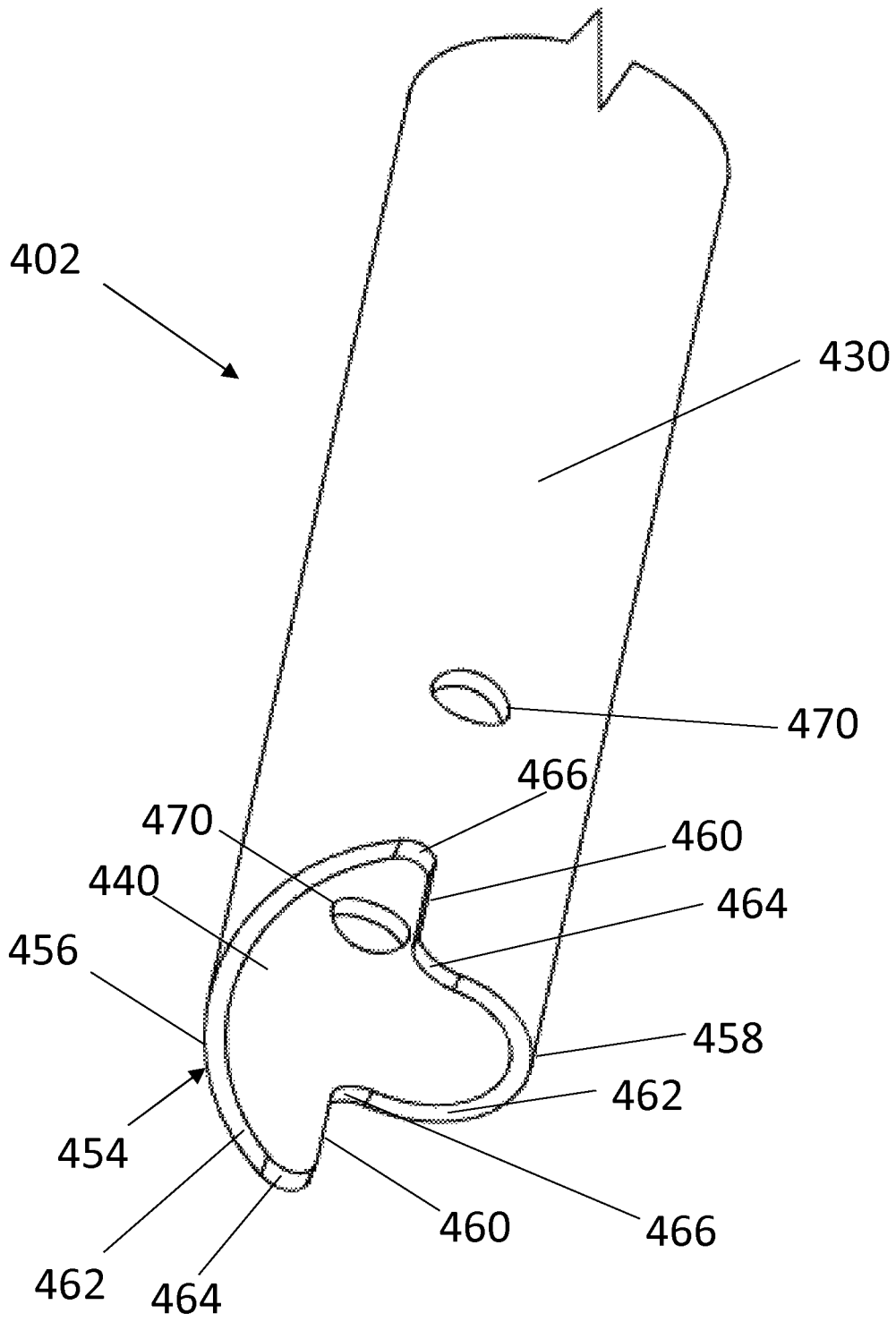
FIG. 6 is an enlarged view of a portion of FIG. 5.

As best shown in the enlarged view of FIG. 6 illustrating the torque transmitting distal end edge 454, each of the torque transmitting distal end edges 452, 454 respectively includes a first asymmetrically shaped torque transmitting tooth 456 and a second asymmetrically shaped torque transmitting tooth 458. Each asymmetric torque transmitting tooth 456 includes a first edge portion 460 that extends parallel to the longitudinal center axis 450 (FIGS. 7 and 10) of the shaft 402 and a second edge portion 462 opposing the first edge portion 460.

Unlike the first edge portion 460, the second edge portion 462 extends obliquely to the longitudinal center axis 450 in each torque transmitting distal end edge 452, 454. Additionally, the first edge portion 460 extends as a linear, flat, or straight edge while the second edge portion 462 extends as a curved edge section with variable slope relative to the to the longitudinal center axis 450. In each tooth 456, 458 the second edge portion 462 includes a projecting high end adjacent a high end of the first edge portion 460 and the second edge portion 462 slopes downwardly toward a low end of the first edge portion 460 of the adjacent tooth. As shown in the example of FIGS. 10 and 14, the second edge portion 462 includes a concave portion at the high end and a convex portion at the low end each having a lower radius of curvature, separated by an intermediate portion having a more consistent slope. The specific shape and geometry of the second edge portion 462 is illustrative rather than limiting, and variations in geometry may be made while realizing similar benefits.

As best shown in FIG. 6, a small convex transition portion 464 extends as a tip between the high end of the straight edge portion 460 and the corresponding high side of the sloped second edge portion 462, and a small concave transition portion 466 extends between the low side of the straight edge portion 460 and the corresponding low side of the sloped second edge portion 462. The transition portions 464, 466, in combination with the first and second edge portions 460, 462 provide a desirable degree of guided, self-alignment of shafts to simplify the assembly of a foundation support system. A slight rotation of one shaft 402 relative to the other will allow the teeth 456, 458 of the shafts 402 to fully engage one another on the distal end edges 452, 454. In some embodiments, however, one or both of the transition portions 464, 466 may be considered optional and may be omitted.

Figure 8:
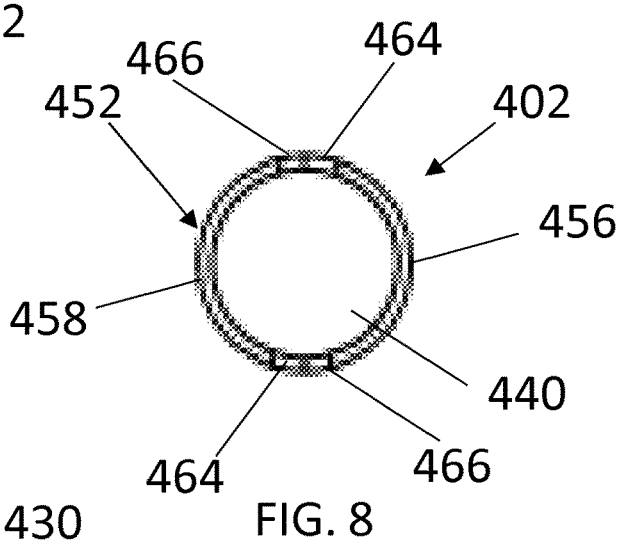
FIG. 8 is an enlarged top end view of the foundation support shaft shown in FIG. 7.

In the side view shown in FIG. 10, which shows the shaft 402 rotated 90° about the longitudinal center axis 450 from the front view shown in FIG. 7, the second edge portions 462 are sloped in different directions (i.e., one has positive slope while the other has negative slope) on opposing sides of the shaft 402. The oppositely sloped edges 462 of the teeth 456, 458 imparts what is sometimes referred to as a Z-shaped edge profile of the torque transmitting distal end edges 452 and 454. The downwardly sloping edge 462 in each tooth 456, 458 between the straight edges 460 is also sometimes referred to herein as a sawtooth pattern or profile of the opposing torque transmitting distal end edges 452 and 454. FIGS. 8, 9 and 10 show that the order of the convex and concave edge portions 464 and 466 are reversed on the circumference of each end 452 and 454. The straight edge portions 460 which are located in between the convex and concave portions 464 and 466 therefore face in opposing directions on the respective distal end edges 452, 454 as shown in FIG. 10.

When the top distal end edge 452 of the shaft 402 is subjected to torque applied about the longitudinal center axis 450 in a clockwise or counterclockwise direction, one of the first edge portion 460 and the second edge portion 462 of each tooth 456, 458 at the bottom distal end edge 454 serves to transmit torque in a forward direction to another mated component such as another shaft 402, while the other of the first edge portion 460 and the second edge portion 462 in each tooth 456, 458 serves to transmit torque in the rearward direction at the bottom distal end edge 454 to another mated component such as another shaft 402. The forward or reverse torque transmission through the shaft 402 will depend on the direction of torque applied at the top distal end edge 452. The torque applied at the top distal end edge 452 may be established through a direct end-to-end distal edge engagement with another shaft 452 or by a drive tool as the foundation support system is being installed.

In the context of the present description the forward torque transmission drives the shaft 402 further into the ground to assemble a pile of sufficient length to anchor the pile at a desired depth to support a building foundation in an installation of a foundation support system. For example, if the forward torque is applied in a clockwise direction the reverse torque is applied in the opposite or counterclockwise direction. In some cases the shaft(s) 402 can be driven forward into the ground with either clockwise or counterclockwise torque, while in other cases one or more of the shaft(s) 402 are configured for a one-way installation that requires them to be driven forward in a specific direction. Regardless, some degree of reverse torque application is typically needed to complete the installation of the foundation support system so both forward and reverse rotation may be expected. The respectively different shape and orientation of the edge portions 460 and 462 in each tooth 456, 468 allows for optimal transmission of forward and reverse torque at both the top and bottom distal end edges 452, 454.

For example, the sloped edge portions 462 of each tooth 456, 458 are longer in length on the circumferences of the end edges 452, 454 while the straight edge portions 460 are shorter in length on the circumference of the end edges 452, 454. That is, the end-to-end axial length of the sloped edge sections 462 that extends obliquely between the straight edge portions 460 is greater than the end-to-end axial length (i.e. the vertical height in the exemplary FIGS. 5-7 and 10) of the straight edged portions 460 that extend parallel to the longitudinal center axis 450. Torque transmission between longer edge portions 462 of mated shafts will accordingly be more distributed than the torque transmission between the shorter edge portions 460.

As such, and in contemplated embodiments, the sloped edge sections 462 may transmit reverse torque along a greater edge area when the shaft 402 is directly engaged end-to-end with another similarly configured shaft, while the shorter edge portions 460 may efficiently transmit forward torque along a shorter edge area. In general, the forward torque needed to complete the installation is greater than the rearward torque needed to complete the installation, so the longer sloped edge sections 462 may desirably transmit relatively low torque force in the reverse direction while the shorter straight edge sections 460 may transmit the relatively high reverse torque forces. The straight edge portions 460, which extend vertically in the installation of the foundation support system, also more efficiently transmit forward torque without slippage and while mechanically isolating the bolted connections from forward torque transmission.

The sloped end edge sections 462, in contrast, transmit reverse torque force without mechanically isolating the bolted connections from reverse torque forces, but since the reverse torque is relatively lower than the forward torque and is distributed over the longer edge area the reverse torque imposed upon the bolts is well below force levels that would raise concerns of shearing of the bolts. Such combination of mechanical isolation of the bolts in the forward torque direction and reduced load on the bolts in the reverse direction facilitates a reduction in the size and strength of the bolts needed to complete the coupled shaft assembly, providing desired cost savings and further ease of assembly of coupled shafts.

The asymmetric teeth 456, 458 including the differently shaped and oriented edge portions 460 and 462 accordingly confer a number of benefits in the coupled shaft assembly relative to symmetrical tooth arrangements that transmit forward and reverse torque without any corresponding differentiation. The asymmetric torque transmitting teeth 456, 458 are advantageously formed in their entirety with a uniform wall thickness that matches the wall thickness of the remainder of the shaft 402, while optimizing distribution of different amounts of forward and reverse torque in an otherwise economical manufacture.

In the example shown, two asymmetric torque transmitting teeth 456, 458 are included in the torque transmitting distal end edges 452 and 454. Each of the projecting end edge portions 460 are at about 180° positions on a circumference of the respective torque transmitting distal end edges 452 and 454, while the sloped end edges 462 spans substantially an entirety of the space between the projecting end edge portions 460. In another embodiment, more than two asymmetric torque transmitting teeth may be provided, with the torque transmission forces being distributed across the number of asymmetric torque transmitting teeth provided. In contemplated embodiments of this type, three or four asymmetric torque transmitting teeth may be provided on greater diameter piles having increased loading capacity in a foundation support system, and which would require greater amounts of torque to drive them to the desired depth for the foundation support system. The asymmetric tooth concept is generally scalable to provide otherwise similar benefits via adding or subtracting to the number of teeth provided in various further and/or alternative embodiments.

While the examples shown include two asymmetric torque transmitting teeth positioned end-to-end in the torque transmitting distal end edges 452 and 454 wherein one tooth ends where the next tooth begins at approximately the same location on the distal end edges, otherwise similar asymmetric torque transmitting teeth could be provided wherein the ends of the teeth 456, 458 are spaced apart from one another on the distal end edges in another embodiment.

As shown in FIGS. 5-7 the shaft 402 also includes a pair of fastener holes 470 proximate the torque transmitting distal end edges 452 and 454. The fastener holes 470 are aligned with the straight edge portion 460 on each side of the shaft 402 in the example shown, although such alignment of the fastener holes 470 with the straight edge portions 460 may be considered options in other embodiments. The fastener holes 470 are arranged in an opposing pair to receive a fastener such as a bolt 406*a*, 406*b* (FIGS. 3, 4, 13, 14 and 15). In the coupled shaft assembly 400 (FIGS. 3 and 4) the fastener holes and bolts realize a cross-bolt connection between the shafts 402*a*, 402*b*, while in the coupled shaft assembly 600 (FIGS. 13-15) the fastener holes and bolts realize an in-line connection between the shafts 402*a*, 402*b*. The benefits of the coupled shaft assemblies 400 and 600 are otherwise similar when the edge portions 460, 462 of the teeth 456, 458 in each shaft 402*a*, 402*b* are directly abutted and engaged inside of the coupler sleeve 404 and fastened in place, establishing a direct torque transmitting connection between the distal ends of the shafts 402*a*, 402*b* in order to drive the coupled shaft assembly to a desired depth in an installation of the foundation support system.

Figure 11:
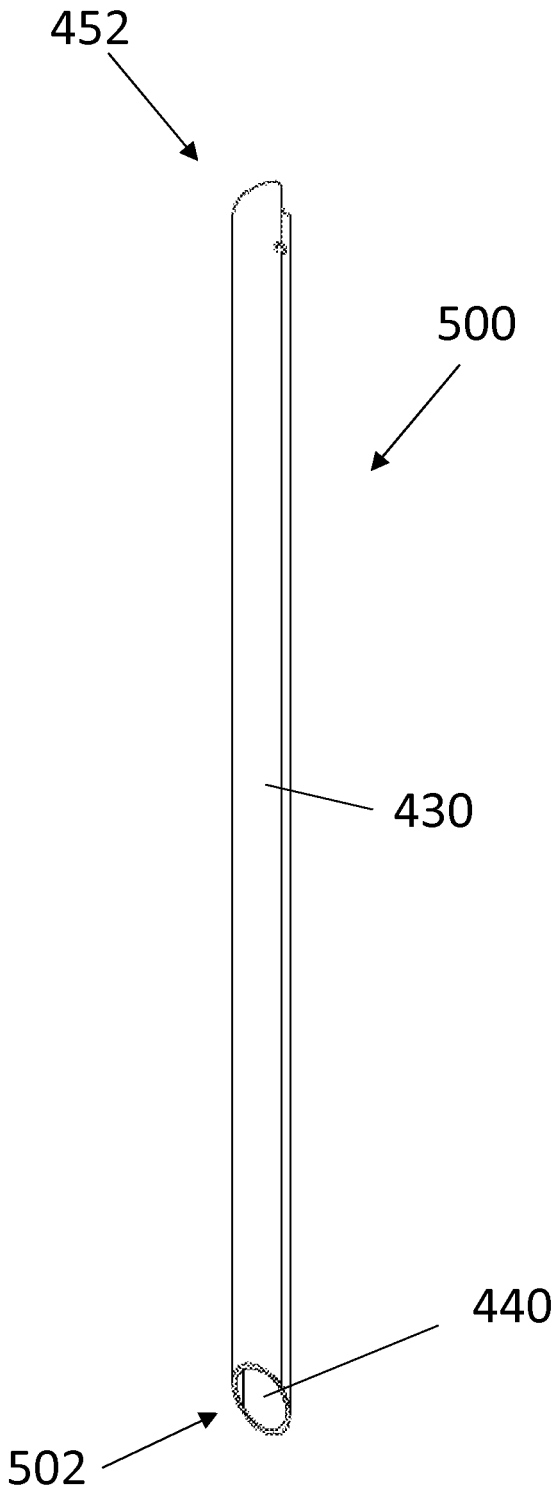
FIG. 11 is a perspective view of a second exemplary foundation support shaft for the coupled shaft assembly shown in FIGS. 3 and 4.
Figure 12:
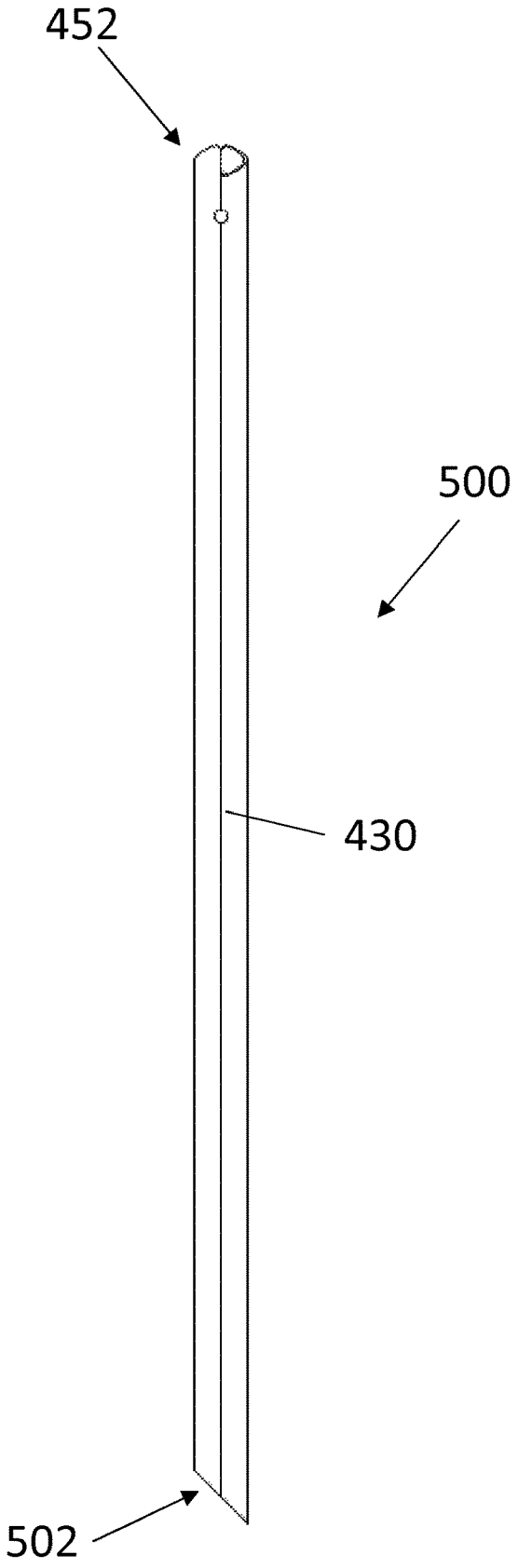
FIG. 12 is a perspective view of a second exemplary foundation support shaft for the coupled shaft assembly shown in FIGS. 3 and 4.

FIGS. 11 and 12 are respective perspective and front views of another embodiment of a shaft 500 that may be used as the shaft 402*a* in the coupled shaft assemblies 400 or 600 in the installation of a foundation support system. The shaft 550 is similar to the shaft 402 in that it include the torque transmitting distal end edge 452 at the top end. Unlike the shaft 402, however, the shaft 500 includes a tapered edge 502 at the opposing bottom end. The tapered edge 502 extends obliquely to the longitudinal axis of the shaft and defines a flat or linearly extending cutting edge or tip at the bottom of the shaft 500 to assist in driving the shaft 500 into the ground when used as, for example, a primary pile. In addition to or in lieu of the tapered edge 502, the shaft 500 may also include a helical auger element to advance the shaft 500 into the earth and/or to anchor the shaft 500 at a desired depth in the installation of a foundation support system.

Like the shaft 402, the shaft 500 can be coupled to another extension pile shaft having a complementary torque transmitting distal edge to the torque transmitting distal end edge 452 at the top end. The shafts can be secured in the torque transmitting arrangement in the coupled shaft assembly 400 or 600. By virtue of the first and second profiled distal end edges 452, 454 of mated shafts, direct torque transmission capability between the shafts is effectively and economically realized without an increased diameter of either of the first and second hollow foundation support shafts.

Figure 16:
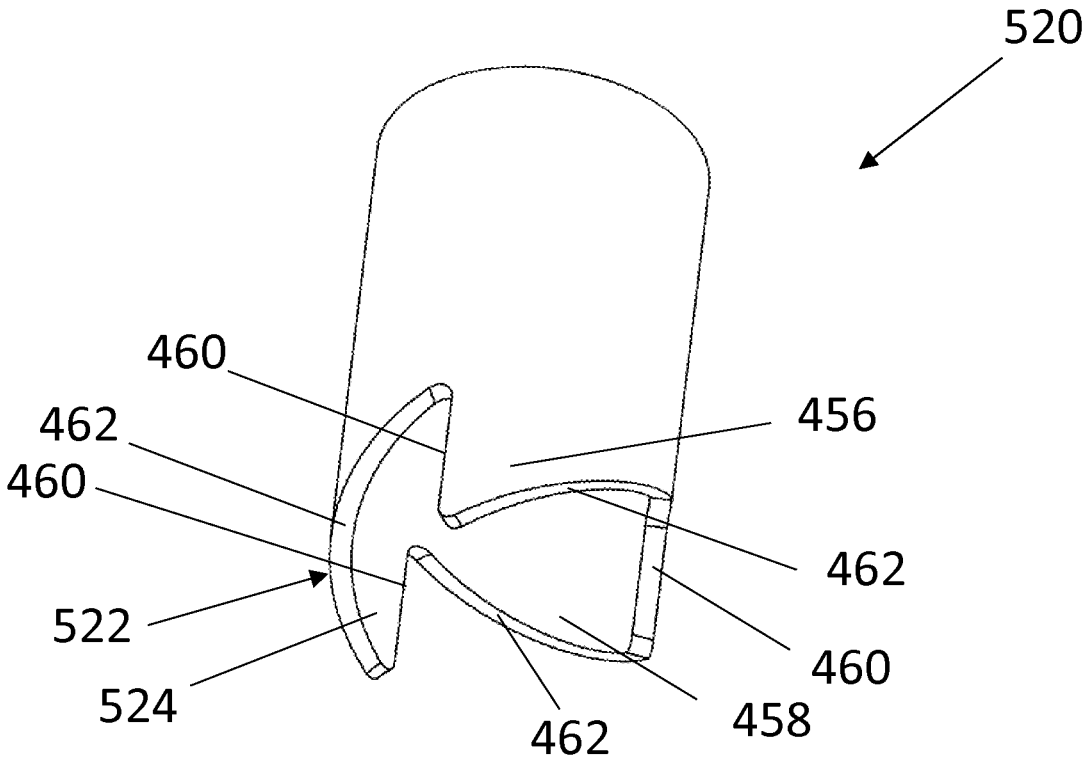
FIG. 16 is a perspective view of a third exemplary foundation support shaft for the coupled shaft assemblies shown in FIGS. 3-4 and 13-15.

FIG. 16 is a perspective view of another exemplary foundation support shaft 520 that may be used in lieu of the shaft 402*a* or 402*b* in the coupled shaft assemblies shown in FIGS. 3-4 and 13-15.

The shaft 520 is similar to the shaft 402 described above, but includes a distal end edge 522 which, in addition to the first asymmetric torque transmitting tooth 456 and the second asymmetric torque transmitting tooth 458, includes a third asymmetric torque transmitting tooth 524 that is otherwise identically formed and shaped to the first and second teeth 456, 458. When the shaft is configured as an extension pile, the opposing distal end edge of the shaft 520 (not shown in FIG. 16) may include identically formed and shaped teeth which may also be reversed in position to that shown in the distal end edge 522. Alternatively, when configured as a primary pile, the opposing distal end of the shaft 520 may include the tapered edge 502 (FIGS. 11 and 12). The shaft 520 may also be provided with a helical auger in some embodiments.

By virtue of the third tooth 524, relatively higher amounts of torque may be transmitted in the distal end edge 522 than in the distal end edge 452 or 452 of the shafts 402 or 500 that each includes two teeth. This may be especially beneficial as the diameter of the shaft 520 is increased relative to the shafts 402, 500 to provide a greater load capacity for the support of a building foundation.

In the example shaft 520, the three teeth 456, 458 and 520 are equally spaced from one another with the straight edge portions 460 located at about 120° positions on the circumference of the distal end edges 452, 454. The three teeth 456, 458, 520 are also shown extending end-to-end with one another on the circumference of the distal end edges 452, 454, although in another embodiment the teeth 456, 458 and 520 may be spaced apart from one another on the circumference while still realizing similar benefits.

Figure 17:
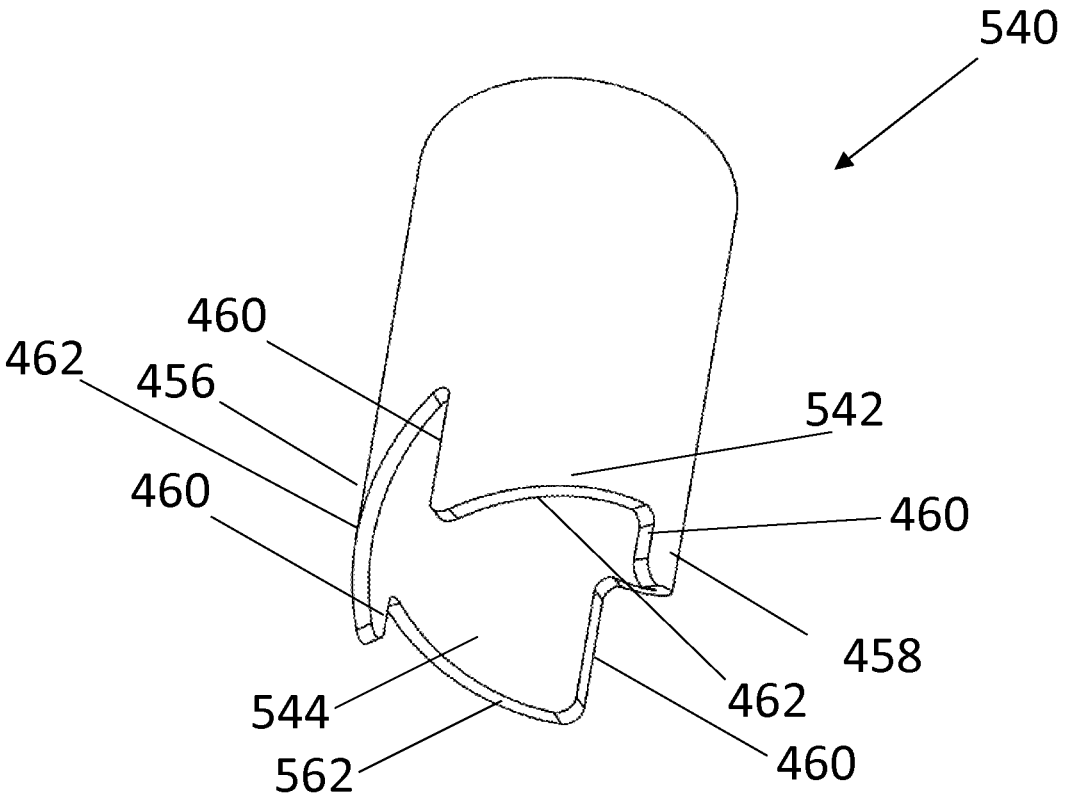
FIG. 17 is a perspective view of a fourth exemplary foundation support shaft for the coupled shaft assemblies shown in FIGS. 3-4 and 13-15.

FIG. 17 is a perspective view of another exemplary foundation support shaft 540 that may be used in lieu of the shaft 402*a* or 402*b* in the coupled shaft assemblies shown in FIGS. 3-4 and 13-15.

The shaft 540 is similar to the shaft 402 described above, but includes in addition to the first asymmetric torque transmitting tooth 456 and the second asymmetric torque transmitting tooth 458, a third asymmetric torque transmitting tooth 542 and a fourth asymmetric torque transmitting tooth 544. The third and fourth teeth 524, 544 are identically formed and shaped to one another, but are smaller in size than the first and second teeth 456, 458. When the shaft is configured as an extension pile, the opposing distal end edge of the shaft 540 (not shown in FIG. 17) may include identically formed and shaped teeth which may also be reversed in position to that shown in FIG. 17. Alternatively, when configured as a primary pile, the opposing distal end of the shaft 540 may include the tapered edge 502 (FIGS. 11 and 12). The shaft 540 may also be provided with a helical auger in some embodiments.

In the example shown, the end-to-end length of the straight edge portion 460 in the third and fourth teeth 542, 544 is smaller than the end-to-end length of the straight edge portion 460 in the first and second teeth 456, 458. Consequently, the straight edge portion 460 in the teeth 542, 544 are taller than the straight edge portion 460 in the teeth 456, 458 and the depth of the teeth 542, 544 is greater than the depth of the teeth 456, 458 on the distal end edges 452, 454. The taller straight edge portions 460 also means that the slope of the sloped edges 462 in the teeth 456, 458 is steeper than in the teeth 542, 544 having shorter straight end edges 460.

As such, the torque transmitting distal end edge in the shaft 540 includes four torque transmitting teeth 456, 458, 542, 544 instead of two or three in the previous embodiments of shafts. By virtue of the third and fourth teeth 524, 544, relatively higher amounts of torque may be transmitted on the distal end edge than in the shaft 520 (FIG. 16).

In the example shaft 540, the straight edge portions 460 of the larger teeth 456, 458 are located at 0° and 180° positions on the circumference of the distal ends 454, 454 while the straight edge portions 460 of the smaller teeth 542, 544 are located at 90° and 270° positions. Such equally spaced and alternating large and small teeth may provide desirable increase in torque transmission capability with a reduced amount of material relative to a shaft having four teeth of the same size. In other embodiments, however, four equally sized teeth may be provided with relatively higher torque transmission capability if desired. The four teeth may be provided end-to-end with one another on the circumference of the distal end edge of the shaft 540 as shown or may be spaced apart from one another on the circumference while still realizing similar benefits.

Figure 18:
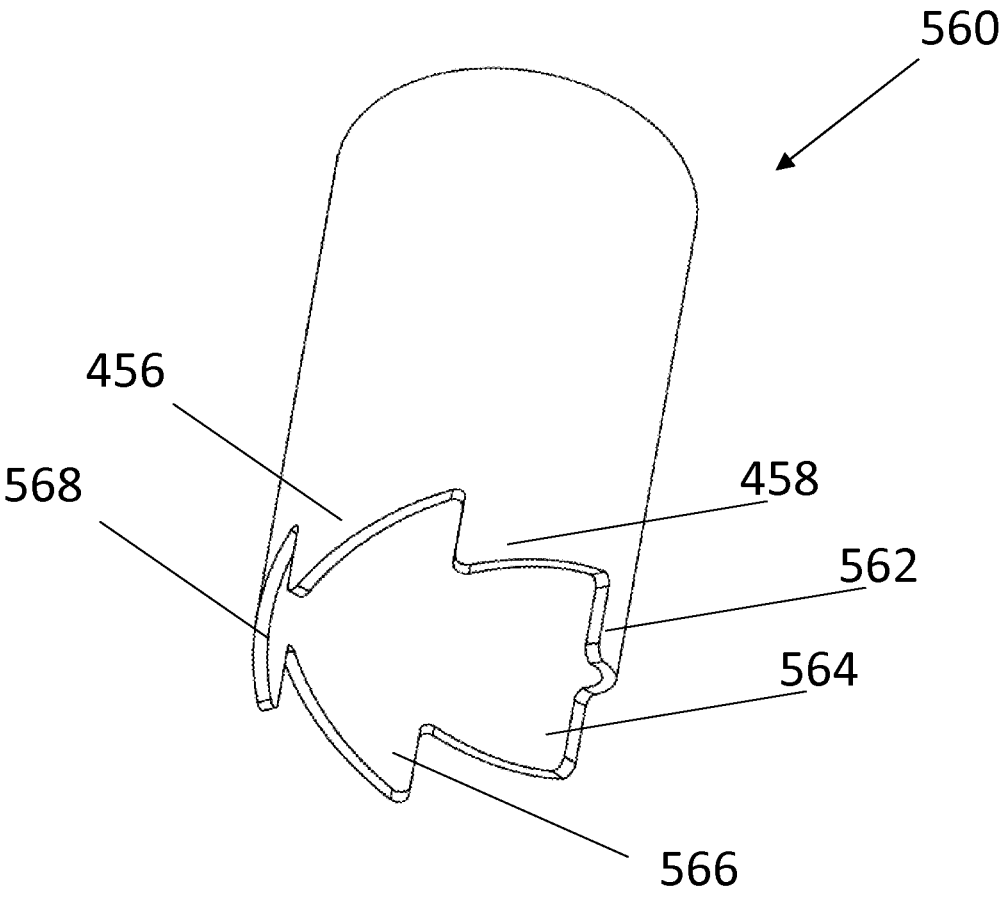
FIG. 18 is a perspective view of a fifth exemplary foundation support shaft for the coupled shaft assemblies shown in FIGS. 3-4 and 13-15.

FIG. 18 is a perspective view of another exemplary foundation support shaft 560 that may be used in lieu of the shaft 402*a* or 402*b* in the coupled shaft assemblies shown in FIGS. 3-4 and 13-15.

The shaft 560 is similar to the shaft 402 described above, but includes six identically formed and shaped asymmetric teeth 456, 458, 562, 564, 566 and 568 on each of the torque transmitting distal end edges 452, 454 in the shaft 560 By virtue of the sixth teeth provided, relatively higher amounts of torque may be transmitted on the distal end edge than shafts having a smaller number of teeth.

In the example shaft 560, the six teeth 456, 458, 562, 564, 566, 568 are equally spaced from one another with the straight edge portions 460 respective located at about 0°, 60°, 120°, 180°, 240° and 300° positions on the circumference of the distal end edges 424, 454. The teeth are also shown extending end-to-end with one another on the circumference of the distal end edges 452, 454, although in another embodiment the teeth 456, 458, 562, 564, 566, 568 may be spaced apart from one another on the circumference while still realizing similar benefits.

Shafts 402, 500, 520, 540 and 560 may be utilized in combination with a grout or cementitious material to enhance a structural strength and capacity of the shafts in the associated foundation support system. Equipment and processes for introducing the grout or cementitious material in the installation of a foundation support system are well-known and may be utilized by those in the art without further explanation.

The benefits and advantages of the invention are now believed to have been amply illustrated by the exemplary embodiments disclosed.

An embodiment of a foundation support system has been disclosed. The foundation support system includes a first hollow foundation support shaft sized and dimensioned to support a building foundation from a below ground location. The first hollow foundation shaft is formed with a first axial length and a first torque transmitting distal end edge, wherein the first torque transmitting distal end edge includes at least one asymmetric torque transmitting tooth, wherein the at least one asymmetric torque transmitting tooth includes a forward torque transmitting edge portion and a rearward force transmitting edge portion opposing the forward torque transmitting edge portion, and wherein the forward torque transmitting edge portion and the rearward torque transmitting edge portion have a respectively different shape and orientation on the first torque transmitting distal end edge.

Optionally, one of the forward torque transmitting edge portion and the rearward torque transmitting edge portion may extend linearly, and wherein the other of the of the forward torque transmitting edge portion and the rearward torque transmitting edge portion may be curved. The torque transmitting edge portion that extends linearly may extend parallel to a longitudinal axis of the first hollow foundation support shaft, and the curved torque transmitting edge portion may extend obliquely to the longitudinal axis of the first hollow foundation support shaft. The first torque transmitting distal end edge may have a circular outer diameter and a circular inner diameter. The at least one asymmetric torque transmitting tooth may be formed in its entirety with a uniform wall thickness, and the first hollow foundation support shaft may be a steel shaft.

Also optionally, the at least one asymmetric torque transmitting tooth may include a plurality of asymmetric torque transmitting tooth arranged in a sawtooth pattern along the first torque transmitting distal end edge. The sawtooth pattern may include at least: a first projecting end edge portion extending parallel to a longitudinal axis of the first hollow foundation support shaft; a second projecting end edge portion extending parallel to the longitudinal axis of the first hollow foundation support shaft, the second projecting end edge portion being spaced from the first projecting end edge portion; and a sloped end edge portion extending between the first projecting end edge portion and the second projecting end edge portion, the sloped end edge portion extending obliquely to the longitudinal axis of the first hollow foundation support shaft The sloped end edge portion may have a varying slope between the first projecting end edge portion and the second projecting end edge portion. Each of the first projecting end edge portion and the second projecting end edge portion may have a high end and a low end, the sloped end edge portion connecting to the high end of the first projecting end edge portion and connecting to the low end of the second projecting end edge portion. The sloped end edge portion may span substantially an entirety of the space between the first projecting end edge portion and the second end projecting end edge portion. The first projecting end edge portion and the second end projecting end edge portion may be at about 180° positions on a circumference of the first torque transmitting distal end edge.

The first hollow foundation support shaft may optionally be further formed with a second profiled distal end edge, wherein the first and second profiled distal end edges are identically shaped to one another, and the second profiled distal end edge may be reversed relative to the first profiled distal end edge.

The at least one asymmetric torque transmitting tooth may optionally include at least two asymmetric torque transmitting teeth formed substantially identically to one another, and the at least two asymmetric torque transmitting teeth may be positioned end-to-end in the first torque transmitting distal end edge.

The first hollow foundation support shaft may optionally include includes at least one fastener hole proximate the first torque transmitting distal end edge, the at least one asymmetric torque transmitting tooth including a straight edge portion extending parallel to a longitudinal axis of the first hollow foundation support shaft, wherein the at least one fastener hole is aligned with the at least one projecting edge portion. The foundation support system may also include a sleeve and a fastener coupling the first torque transmitting distal end edge to the sleeve via the fastener hole. The fastener may be a bolt, and the bolt may be mechanically isolated from a forward torque transmission only while being mechanically loaded in a reverse forward torque transmission. The sleeve may surround a portion of the first hollow foundation support shaft including the first torque transmitting distal end edge. The at least one fastener hole may include a pair of fastener holes.

The foundation support assembly may also include a second hollow foundation support shaft formed with a second axial length and a second torque transmitting distal end edge formed substantially identically to the first torque transmitting distal end edge; wherein when the first torque transmitting distal end edge and the second torque transmitting distal end edge are directly abutted and engaged to one another, a torque transmitting connection is established between the first hollow foundation support shaft and the second hollow foundation support shaft in order to drive the first and second hollow foundation support shaft to a desired depth in an installation of the foundation support system. The first and second torque transmitting distal end edges may provide torque transmission capability without an increased diameter of either of the first and second hollow foundation support shafts. The second hollow foundation support shaft may be fastened to the sleeve. The first and second hollow support shaft may have one of a circular cross-sectional shape, a square cross-sectional shape or a hexagonal cross-sectional shape. The sleeve may have one of a circular cross-sectional shape, a square cross-sectional shape or a hexagonal cross-sectional shape. The sleeve may have an axial length, wherein the sleeve is formed with a uniform wall thickness along an entirety of the axial length.

The first hollow foundation support shaft may optionally include a tapered end opposite to the first torque transmitting distal end edge. The first hollow foundation support shaft may be configured as a primary pile or as an extension pile in the foundation support system. The first hollow foundation support shaft may include a helical auger. The foundation support system may further include a cap, a plate, or a lift bracket to support the building foundation in combination with the first hollow foundation support shaft. The foundation support system may be provided in combination with a grout or cementitious material to enhance a structural strength and capacity of the first hollow foundation support shaft.

The at least one asymmetric torque transmitting tooth may optionally include at least three asymmetric torque transmitting teeth. The at least three asymmetric torque transmitting teeth may include a first asymmetric torque transmitting tooth having a first size and a second asymmetric torque transmitting teeth having a second size different from the first size. The at least three asymmetric torque transmitting teeth may include six asymmetric torque transmitting teeth.

The at least one asymmetric torque transmitting tooth may include at least four asymmetric torque transmitting teeth.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A foundation support system comprising:

a first hollow steel shaft sized and dimensioned to support a building foundation from a below ground location, the first hollow steel shaft formed with a first longitudinal axis, a first axial length measured along the first longitudinal axis and a first torque transmitting distal end edge;

wherein the first torque transmitting distal end edge includes a first asymmetric torque transmitting tooth and a second asymmetric torque transmitting tooth; and wherein each of the first asymmetric torque transmitting tooth and the second asymmetric torque transmitting tooth includes a forward torque transmitting edge portion extending parallel to the first longitudinal axis and a rearward force transmitting edge portion extending obliquely to the first longitudinal axis and adjacent to the forward torque transmitting edge portion;

a second hollow steel shaft sized and dimensioned to support the building foundation in combination with the first hollow steel shaft, the second hollow steel shaft formed with a second longitudinal axis, a second axial length measured along the first longitudinal axis and a second torque transmitting distal end edge complementary to the first torque transmitting distal end edge; and a coupler sleeve and at least one fastener extending through the coupler sleeve to maintain an engaged position of the first torque transmitting edge and the second torque transmitting edge in order to drive the first hollow steel shaft and second hollow steel shaft to a desired depth in an installation of the foundation support system.

2. The foundation support system of claim 1, wherein the rearward torque transmitting edge portion is curved.

3. The foundation support system of claim 2, wherein the forward torque transmission edge portion has a first length and wherein the rearward torque transmission edge portion has a second length, the first length being less than the second length.

4. The foundation support system of claim 1, wherein the first torque transmitting distal end edge has a circular outer diameter and a circular inner diameter.

5. The foundation support system of claim 4, wherein the first and second asymmetric torque transmitting teeth are formed in its their entirety with a uniform wall thickness equal to a wall thickness of the first hollow foundation support shaft.

6. The foundation support system of claim 1, wherein the rearward force transmitting edge portion has a varying slope in each of the first asymmetric torque transmitting tooth and the second asymmetric torque transmitting tooth.

7. The foundation support system of claim 6, wherein the forward torque transmitting edge portion has a high end and a low end in each respective one of the first asymmetric torque transmitting tooth and the second asymmetric torque transmitting tooth, the rearward force transmitting edge portion extending from the high end of the first asymmetric torque transmitting tooth and extending to the low end of the second asymmetric torque transmitting tooth.

8. The foundation support system of claim 7, wherein the rearward force transmitting edge portion spans substantially an entirety of a circumferential space between the respective high end and the low end of each respective forward torque transmitting edge portion in the first asymmetric torque transmitting tooth and the second asymmetric torque transmitting tooth.

9. The foundation support system of claim 7, wherein the first projecting end edge portion and the second end projecting end edge portion are at about 180° positions on a circumference of the first torque transmitting distal end edge.

10. The foundation support system of claim 1, wherein the first and second asymmetric torque transmitting teeth are positioned end-to-end in the first torque transmitting distal end edge, and wherein the first and second asymmetric torque transmitting teeth occupy an entirety of a circumference of the first torque transmitting distal end edge.

11. The foundation support system of claim 1, wherein the first hollow foundation support shaft includes at least one fastener hole proximate the first torque transmitting distal end edge, and wherein the at least one fastener hole is aligned with the forward torque transmitting edge portion.

12. The foundation support system of claim 1, wherein the at least one fastener is a bolt.

13. The foundation support system of claim 12, wherein the bolt is mechanically isolated from a forward torque transmission, and wherein the bolt is not mechanically isolated from a rearward force transmission.

14. The foundation support system of claim 1, wherein the coupler sleeve includes a pair of fastener holes.

15. The foundation support system of claim 1, wherein the first and second hollow steel shaft have a circular cross-sectional shape.

16. The foundation support system of claim 1, wherein the coupler sleeve has a circular cross-sectional shape.

17. The foundation support system of claim 1, wherein the first hollow steel shaft includes a tapered end opposite to the first torque transmitting distal end edge.

18. The foundation support system of claim 1, wherein the first hollow steel shaft is configured as a primary pile and the second hollow steel shaft is configured as an extension pile in the foundation support system.

19. The foundation support system of claim 18, wherein the primary pile includes a helical auger.

20. The foundation support system of claim 1, further comprising a cap, a plate, or a lift bracket to support the building foundation in combination with the first hollow steel shaft and the second hollow steel shaft.

21. The foundation support system of claim 1, in combination with a grout or cementitious material to enhance a structural strength and capacity of the first hollow steel shaft.

22. The foundation support system of claim 1, wherein the first torque transmitting distal end edge further includes a third asymmetric torque transmitting tooth.

23. The foundation support system of claim 22, wherein the first torque transmitting distal end edge includes six asymmetric torque transmitting teeth.

24. The foundation support system of claim 1, wherein the first torque transmitting distal end edge includes at least four asymmetric torque transmitting teeth.

25. The foundation support system of claim 1, wherein the coupler sleeve is formed with a pair of fastener holes, and wherein the first steel shaft is formed with a pair of fastener holes, the at least one fastener extending through the pair of holes in the coupler sleeve and the pair of holes in the first steel shaft to maintain an engaged position of the first torque transmitting edge and the second torque transmitting edge.

26. The foundation support of claim 1, wherein the coupler sleeve is formed with a pair of fastener holes, and wherein the second steel shaft is formed with a pair of fastener holes, the at least one fastener extending through the pair of holes in the coupler sleeve and the pair of holes in the second steel shaft to maintain an engaged position of the first torque transmitting edge and the second torque transmitting edge.

27. The foundation support system of claim 1, wherein the coupler sleeve is attached to the first steel shaft and includes a pair of fastener holes, wherein the second steel shaft is formed with a pair of fastener holes, and wherein the at least one fastener extends through the pair of holes in the coupler sleeve and the pair of holes in the second steel shaft to maintain an engaged position of the first torque transmitting edge and the second torque transmitting edge.

28. The foundation support system of claim 1, wherein the coupler sleeve is attached to the second steel shaft and includes a pair of fastener holes, wherein the first steel shaft is formed with a pair of fastener holes, and wherein the at least one fastener extends through the pair of holes in the coupler sleeve and the pair of holes in the first steel shaft to maintain an engaged position of the first torque transmitting edge and the second torque transmitting edge.

29. The foundation support system of claim 1, wherein the coupler sleeve includes a first pair of holes and a second pair of holes and wherein the at least one fastener comprises a first fastener and a second fastener.

30. The foundation support system of claim 29, wherein the first pair of holes and the second pair of holes accept the first and second fasteners in an orthogonal orientation to one another.

31. The foundation support system of claim 29, wherein the first pair of holes and the first fastener attach the first steel shaft to the coupler sleeve, and wherein the second pair of holes and the second fastener attach the second steel shaft to the coupler sleeve.

32. The foundation support system of claim 1, wherein the coupler sleeve is slidably attached to at least one of the first steel shaft and the second steel shaft.

33. The foundation support system of claim 1, wherein the coupler sleeve is an external coupler sleeve extending around an outer circumference of at least one of the first steel shaft and the second steel shaft.

34. The foundation support system of claim 1, wherein the coupler sleeve is an internal coupler sleeve extending interior to at least one of the first steel shaft and the second steel shaft.

35. A foundation support system comprising:

a first hollow foundation support shaft sized and dimensioned to support a building foundation from a below ground location, the first hollow foundation shaft formed with a first longitudinal axis, a first axial length measured along the first longitudinal axis and a first torque transmitting distal end edge;

wherein the first torque transmitting distal end edge includes a first asymmetric torque transmitting tooth and a second asymmetric torque transmitting tooth; and wherein each of the first asymmetric torque transmitting tooth and the second asymmetric torque transmitting tooth includes a forward torque transmitting edge portion extending parallel to the first longitudinal axis and a rearward force transmitting edge portion extending obliquely to the first longitudinal axis and adjacent to the forward torque transmitting edge portion;

wherein the first torque transmitting distal end edge further includes a third asymmetric torque transmitting tooth;

wherein the first, second and third asymmetric torque transmitting teeth includes an asymmetric torque transmitting tooth having a first size and an asymmetric torque transmitting teeth having a second size different from the first size.

36. A foundation support system comprising:

a first hollow foundation support shaft sized and dimensioned to support a building foundation from a below ground location, the first hollow foundation shaft formed with a first longitudinal axis, a first axial length measured along the first longitudinal axis and a first torque transmitting distal end edge;

a second hollow foundation support shaft sized and dimensioned to support the building foundation from a below ground location in combination with the first hollow support foundation shaft, the second hollow foundation shaft formed with a second longitudinal axis, a second axial length measured along the second longitudinal axis and a second torque transmitting distal end edge; and a sleeve for coupling the first hollow foundation support shaft and the second hollow foundation support shaft with respective first and second fasteners while the first and second torque transmitting distal ends are directly engaged to one another;

wherein each of the first and second torque transmitting distal ends includes a plurality of asymmetric torque transmitting teeth each having a torque transmitting edge portion extending parallel to the first longitudinal axis or the second longitudinal axis and a torque transmitting edge portion that does not extend parallel to the first longitudinal axis or the second longitudinal axis; and wherein each of the plurality of asymmetric torque transmitting teeth are configured to respectively transmit a forward transmission of torque and a rearward transmission of torque between the directly engaged first and second torque transmitting distal ends; and wherein in one of the forward transmission of torque and the rearward transmission of torque the fasteners are mechanically isolated.

37. A foundation support system comprising:

a first steel shaft dimensioned to support a building foundation from a below ground location, the first steel shaft formed with a first longitudinal axis, a first axial length measured along the first longitudinal axis and a first torque transmitting distal end edge;

a second steel shaft sized and dimensioned to support the building foundation from a below ground location in combination with the first hollow support foundation shaft, the second steel shaft formed with a second longitudinal axis, a second axial length measured along the second longitudinal axis and a second torque transmitting distal end edge, wherein at least one of the first and second steel shaft includes a helical auger; and a sleeve for coupling the first hollow foundation support shaft and the second hollow foundation support shaft with respective first and second fasteners while the first and second torque transmitting distal ends are directly engaged to one another;

wherein each of the first and second torque transmitting distal ends includes a plurality of asymmetric torque transmitting teeth each configured to be directly engaged to one another to transmit torque in a first direction along a first edge area and to transmit torque in a second direction along a second edge area, wherein the second edge area is greater than the first edge area.

* * * * *